US006142119A

United States Patent [19]

Abe et al.

[11] Patent Number: 6,142,119

[45] Date of Patent: Nov. 7, 2000

[54] COMPRESSION IGNITION TYPE ENGINE

[75] Inventors: Tsukasa Abe, Susono; Shinji Ikeda, Mishima; Shizuo Sasaki, Numazu; Takekazu Ito, Susono, all of Japan

[73] Assignee: Toyota Jidosha Kabushiki Kaisha, Toyota, Japan

[21] Appl. No.: 09/149,136

[22] Filed: Sep. 8, 1998

[30] Foreign Application Priority Data

Sep. 16, 1997 [JP] Japan ..... 9-250965

[51] Int. Cl.[7] ..... F02D 43/04; F02D 41/04; F02M 25/07

[52] U.S. Cl. ..... 123/435; 123/568.21; 123/436

[58] Field of Search ..... 123/305, 295, 123/435, 436, 568.21, 568.26, 568.27; 60/277, 276, 274

[56] References Cited

U.S. PATENT DOCUMENTS

| | | | |
|---|---|---|---|
| 4,142,493 | 3/1979 | Schira et al. | 123/568.21 |
| 4,454,854 | 6/1984 | Gotoh et al. | 123/568.27 |
| 5,172,550 | 12/1992 | Takeshima | 60/278 |
| 5,458,102 | 10/1995 | Tomisawa et al. | 123/435 |
| 5,474,045 | 12/1995 | Demizu et al. | 123/435 |
| 5,482,020 | 1/1996 | Shimizu et al. | 123/406.47 |
| 5,497,328 | 3/1996 | Sugai et al. | 123/435 |
| 5,632,144 | 5/1997 | Isobe | 60/277 |
| 5,682,856 | 11/1997 | Tomisawa et al. | 123/435 |
| 5,718,203 | 2/1998 | Shimada et al. | 123/435 |
| 5,732,554 | 3/1998 | Sasaki et al. | 60/278 |
| 5,765,532 | 6/1998 | Loye | 123/435 |

FOREIGN PATENT DOCUMENTS

| | | |
|---|---|---|
| 58-155236 | 9/1983 | Japan . |
| 4-334750 | 11/1992 | Japan . |
| 6-346763 | 12/1994 | Japan . |
| 7-4287 | 1/1995 | Japan . |

OTHER PUBLICATIONS

Y. Sato et al., *ASimultaneous Reduction of NOx and Soot in Diesel Engines Under a New Combustion System*, Paper No. 205, Spring Symposium, held by Society of Automotive Engineers of Japan, pp. 81–84.

*Primary Examiner*—Willis R. Wolfe
*Attorney, Agent, or Firm*—Oliff & Berridge, PLC

[57] ABSTRACT

A compression ignition type engine comprising a combustion pressure sensor arranged in the combustion chamber, wherein whether defective combustion is occurring or not is judged from a change in the combustion pressure and the air-fuel ratio is made larger when it is judged that defective combustion is occurring.

19 Claims, 22 Drawing Sheets

Fig.13A

| | | | | |
|---|---|---|---|---|
| L | $AFKT1_{11}$ | $AFKT1_{12}$ | ---- | $AFKT1_{1n}$ |
| | $AFKT1_{21}$ | | | |
| | ⋮ | | | ⋮ |
| | $AFKT1_{n1}$ | ---------- | | $AFKT1_{mn}$ |
| | | | | N |

Fig.13B

| | | | | |
|---|---|---|---|---|
| L | $AFKT2_{11}$ | $AFKT2_{12}$ | --- | $AFKT2_{1n}$ |
| | $AFKT2_{21}$ | | | |
| | ⋮ | | | ⋮ |
| | $AFKT2_{m1}$ | --------- | | $AFKT2_{mn}$ |
| | | | | N |

Fig.13C

| | | | | |
|---|---|---|---|---|
| L | $AFKT3_{11}$ | $AFKT3_{12}$ | --- | $AFKT3_{1n}$ |
| | $AFKT3_{21}$ | | | |
| | ⋮ | | | ⋮ |
| | $AFKT3_{m1}$ | -------- | | $AFKT3_{mn}$ |
| | | | | N |

Fig.13D

| | | | | |
|---|---|---|---|---|
| L | $AFKT4_{11}$ | $AFKT4_{12}$ | --- | $AFKT4_{1n}$ |
| | $AFKT4_{21}$ | | | |
| | ⋮ | | | ⋮ |
| | $AFKT4_{m1}$ | --------- | | $AFKT4_{mn}$ |
| | | | | N |

Fig.15A

| | | | | |
|---|---|---|---|---|
| L | $SE15_{11}$ | $SE15_{12}$ | ----- | $SE15_{1n}$ |
| | $SE15_{21}$ | | | |
| | ⋮ | | | ⋮ |
| | $SE15_{m1}$ | ---------- | | $SE15_{mn}$ |
| | | | | N |

Fig.15B

| | | | | |
|---|---|---|---|---|
| L | $SE16_{11}$ | $SE16_{12}$ | ----- | $SE16_{1n}$ |
| | $SE16_{21}$ | | | |
| | ⋮ | | | ⋮ |
| | $SE16_{m1}$ | ---------- | | $SE16_{mn}$ |
| | | | | N |

Fig.15C

| | | | | |
|---|---|---|---|---|
| L | $SE17_{11}$ | $SE17_{12}$ | ----- | $SE17_{1n}$ |
| | $SE17_{21}$ | | | |
| | ⋮ | | | ⋮ |
| | $SE17_{m1}$ | ---------- | | $SE17_{mn}$ |
| | | | | N |

Fig.15D

| | | | | |
|---|---|---|---|---|
| L | $SE18_{11}$ | $SE18_{12}$ | ----- | $SE18_{1n}$ |
| | $SE18_{21}$ | | | |
| | ⋮ | | | ⋮ |
| | $SE18_{m1}$ | ---------- | | $SE18_{mn}$ |
| | | | | N |

| L | | | | |
|---|---|---|---|---|
| | $\theta S_{11}$ | $\theta S_{12}$ | ------- | $\theta S_{1n}$ |
| | $\theta S_{21}$ | | | ⋮ |
| | ⋮ | | | |
| | $\theta S_{m1}$ | ---------- | | $\theta S_{mn}$ |
| | | | | N |

COMPRESSION IGNITION TYPE ENGINE

BACKGROUND OF THE INVENTION

1. Field of the Invention

The present invention relates to a compression ignition type engine.

2. Description of the Related Art

In the past, in an internal combustion engine, for example, a diesel engine, the production of NOx has been suppressed by connecting the engine exhaust passage and the engine intake passage by an exhaust gas recirculation (EGR) passage so as to cause the exhaust gas, that is, the EGR gas, to recirculate in the engine intake passage through the EGR passage. In this case, the EGR gas has a relatively high specific heat and therefore can absorb a large amount of heat, so the larger the amount of EGR gas, that is, the higher the EGR rate (amount of EGR gas) (amount of EGR gas+ amount of intake air), the lower the combustion temperature in the engine intake passage. When the combustion temperature falls, the amount of NOx produced falls and therefore the higher the EGR rate, the lower the amount of NOx produced.

In this way, in the past, the higher the EGR rate, the lower the amount of NOx produced can become. If the EGR rate is increased, however, the amount of soot produced, that is, the smoke, starts to sharply rise when the EGR rate passes a certain limit. In this point, in the past, it was believed that if the EGR rate was increased, the smoke would increase without limit. Therefore, it was believed that the EGR rate at which smoke starts to rise sharply was the maximum allowable limit of the EGR rate.

Therefore, in the past, the EGR rate was set within a range not exceeding the maximum allowable limit (for example, see Japanese Unexamined Patent Publication (Kokai) No. 4-334750). The maximum allowable limit of the EGR rate differed considerably according to the type of the engine and the fuel, but was from 30 percent to 50 percent or so. Accordingly, in conventional diesel engines, the EGR rate was suppressed to 30 percent to 50 percent at a maximum.

Since it was believed in the past that there was a maximum allowable limit to the EGR rate, in the past the EGR rate had been set so that the amount of NOx and smoke produced would become as small as possible within a range not exceeding that maximum allowable limit. Even if the EGR rate is set in this way so that the amount of NOx and smoke produced becomes as small as possible, however, there are limits to the reduction of the amount of production of NOx and smoke. In practice, therefore, a considerable amount of NOx and smoke continues being produced.

The present inventors, however, discovered in the process of studies on the combustion in diesel engines that if the EGR rate is made larger than the maximum allowable limit, the smoke sharply increases as explained above, but there is a peak to the amount of the smoke produced and once this peak is passed, if the EGR rate is made further larger, the smoke starts to sharply decrease and that if the EGR rate is made at least 70 percent during engine idling or if the EGR gas is force cooled and the EGR rate is made at least 55 percent or so, the smoke will almost completely disappear, that is, almost no soot will be produced. Further, they found that the amount of NOx produced at this time was extremely small. They engaged in further studies later based on this discovery to determine the reasons why soot was not produced and as a result constructed a new system of combustion able to simultaneously reduce the soot and NOx more than ever before. This new system of combustion will be explained in detail later, but briefly it is based on the idea of stopping the growth of hydrocarbons into soot at a stage before the hydrocarbons grow to soot.

That is, what was found from repeated experiments and research was that the growth of hydrocarbons into soot stops at a stage before that happens when the temperatures of the fuel and the gas around the fuel at the time of combustion in the combustion chamber are lower than a certain temperature and the hydrocarbons grow to soot all at once when the temperatures of the fuel and the gas around the fuel become higher than a certain temperature. In this case, the temperatures of the fuel and the gas around the fuel are greatly affected by the heat absorbing action of the gas around the fuel at the time of combustion of the fuel. By adjusting the amount of heat absorbed by the gas around the fuel in accordance with the amount of heat generated at the time of combustion of the fuel, it is possible to control the temperatures of the fuel and the gas around the fuel.

Therefore, if the temperatures of the fuel and the gas around the fuel at the time of combustion in the combustion chamber are suppressed to less than the temperature at which the growth of the hydrocarbons stops midway, soot is no longer produced. The temperatures of the fuel and the gas around the fuel at the time of combustion in the combustion chamber can be suppressed to less than the temperature at which the growth of the hydrocarbons stops midway by adjusting the amount of heat absorbed by the gas around the fuel. On the other hand, the hydrocarbons stopped in growth midway before becoming soot can be easily removed by after-treatment using an oxidation catalyst etc. This is the basic thinking behind this new system of combustion.

In the conventional compression ignition type engine, however, if the air-fuel ratio is made small, defective combustion inevitably occurs and finally the engine misfires. The same is true in this new system of combustion. If the air-fuel ratio is made smaller, defective combustion inevitably occurs and finally the engine misfires. In the compression ignition type engines up to now, however, no steps were taken to deal with such defective combustion. Note that the "defective combustion" referred to here means the state where the fluctuation of the output torque of the engine or the fluctuation in combustion becomes more than an allowable value. The worst case of defective combustion is a misfire.

SUMMARY OF THE INVENTION

An object of the present invention is to provide a compression ignition type engine capable of controlling the operating state when defective combustion occurs to an operating state free of defective combustion.

According to the present invention, there is provided a compression ignition type engine provided with defective combustion judging means for judging if defective combustion is occurring or not and control means for controlling one of an air-fuel ratio and fuel injection timing so that combustion becomes good when defective combustion is occurring.

BRIEF DESCRIPTION OF THE DRAWINGS

The present invention may be more fully understood from the description of the preferred embodiments of the invention set forth below together with the accompanying drawings, in which:

FIGS. 13A to 13D are views of a map of a target air-fuel ratio;

FIGS. 15A to 15D are views of a target basic opening degree of an EGR control valve;

DESCRIPTION OF THE PREFERRED EMBODIMENTS

Figure 1:
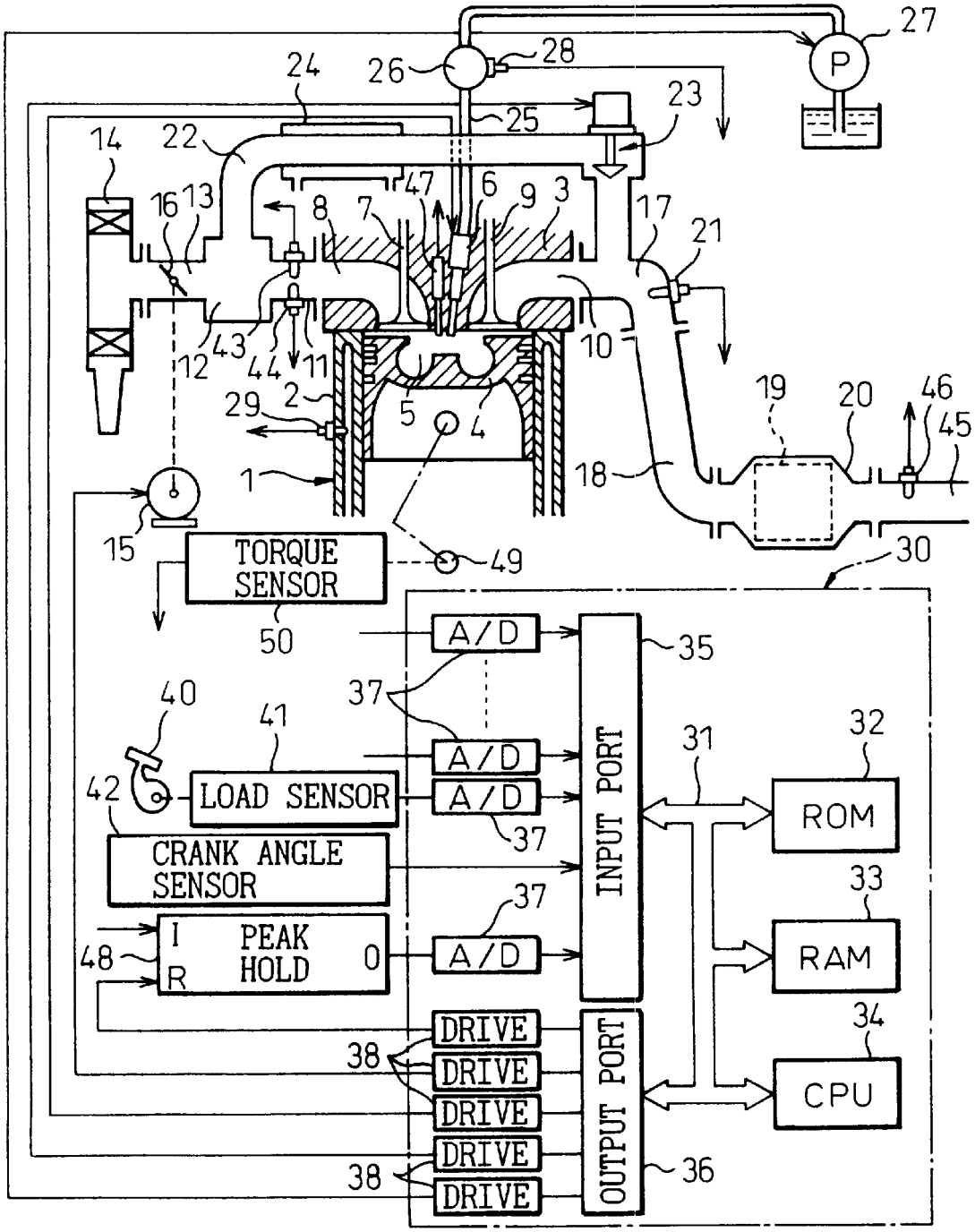
FIG. 1 is an overall view of a compression ignition type engine.

FIG. 1 is a view of the case of application of the present invention to a four-stroke compression ignition type engine.

Referring to FIG. 1, 1 shows an engine body, 2 a cylinder block, 3 a cylinder head, 4 a piston, 5 a combustion chamber, 6 an electrically controlled fuel injector, 7 an intake valve, 8 an intake port, 9 an exhaust valve, and 10 an exhaust port. The intake port 8 is connected through a corresponding intake tube 11 to the surge tank 12. The surge tank 12 is connected through an intake duct 13 to an air cleaner 14. A throttle valve 16 driven by an electric motor 15 is arranged in the intake duct 13. On the other hand, the exhaust port 10 is connected through an exhaust manifold 17 and exhaust tube 18 to a catalytic converter 20 housing a catalyst 19 having an oxidation action. An air fuel ratio sensor 21 is arranged in the exhaust manifold 17.

The exhaust manifold 17 and surge tank 12 are connected with each other through an EGR passage 22. An electrically controlled EGR control valve 23 is arranged in an EGR passage 22. Further, a cooling apparatus 24 for cooling the EGR gas flowing through the EGR passage 22 is provided around the EGR passage 22. In the embodiment shown in FIG. 1, the engine cooling water is guided to the cooling apparatus 24 where the engine cooling water is used to cool the EGR gas.

On the other hand, each fuel injector 6 is connected through a fuel supply tube 25 to the fuel reservoir, that is, a common rail 26. Fuel is supplied to the common rail 26 from an electrically controlled variable discharge fuel pump 27. Fuel supplied in the common rail 26 is supplied through each fuel supply tube 25 to the fuel injectors 6. A fuel pressure sensor 28 for detecting the fuel pressure in the common rail 26 is attached to the common rail 26. The amount of discharge of the fuel pump 27 is controlled based on the output signal of the fuel pressure sensor 28 so that the fuel pressure in the common rail 26 becomes the target fuel pressure.

The electronic control unit 30 is comprised of a digital computer and is provided with a ROM (read only memory) 32, a RAM (random access memory) 33, a CPU (microprocessor) 34, an input port 35, and an output port 36 connected with each other by a bidirectional bus 31. The output signal of the air fuel ratio sensor 21 is input through a corresponding AD converter 37 to the input port 35. Further, the output signal of the fuel pressure sensor 28 is input through a corresponding AD converter 37 to the input port 35. The engine body 1 is provided with a temperature sensor 29 for detecting the engine cooling water temperature. The output signal of this temperature sensor 29 is input through a corresponding AD converter 37 to the input port 35. Further, a temperature sensor 43 for detecting the temperature of the mixed gas of the suction air and the EGR gas is mounted in at least one of the intake tubes 11. The output signal of the temperature sensor 43 is input through a corresponding AD converter 37 to the input port 35. Further, an oxygen concentration sensor 44 is arranged in at least one of the intake tubes 11. The output signal of the oxygen concentration sensor 44 is input through a corresponding AD converter 37 to the input port 35.

Further, a temperature sensor 46 for detecting the temperature of the exhaust gas passing through the catalyst 19 is arranged in the exhaust pipe 45 downstream of the catalyst 19. The output signal of the temperature sensor 46 is input through a corresponding AD converter 37 to the input port 35. A combustion pressure sensor 47 for detecting the pressure inside the combustion chamber 5 is arranged in the combustion chamber 5. The output signal of the combustion pressure sensor 47 is connected to the input terminal I of a peak hold circuit 48. The output terminal O of the peak hold circuit 48 is connected through a corresponding AD converter 37 to the input port 35. Further, a torque sensor 50 for detecting an output torque of the engine is attached to the crankshaft 49. The output signal of the torque sensor 50 is input through a corresponding AD converter 37 to the input port 35.

The accelerator pedal 40 has connected to it a load sensor 41 for generating an output voltage proportional to the amount of depression L of the accelerator pedal 40. The output voltage of the load sensor 41 is input through a corresponding AD converter 37 to the input port 35. Further, the input port 35 has connected to it a crank angle sensor 42 for generating an output pulse each time the crankshaft rotates by for example 30°. On the other hand, the output port 36 has connected to it through a corresponding drive circuit 38 the fuel injector 6, electric motor 15, EGR control valve 23, fuel pump 27, and a reset input terminal R of the peak hold circuit 48.

Figure 2:
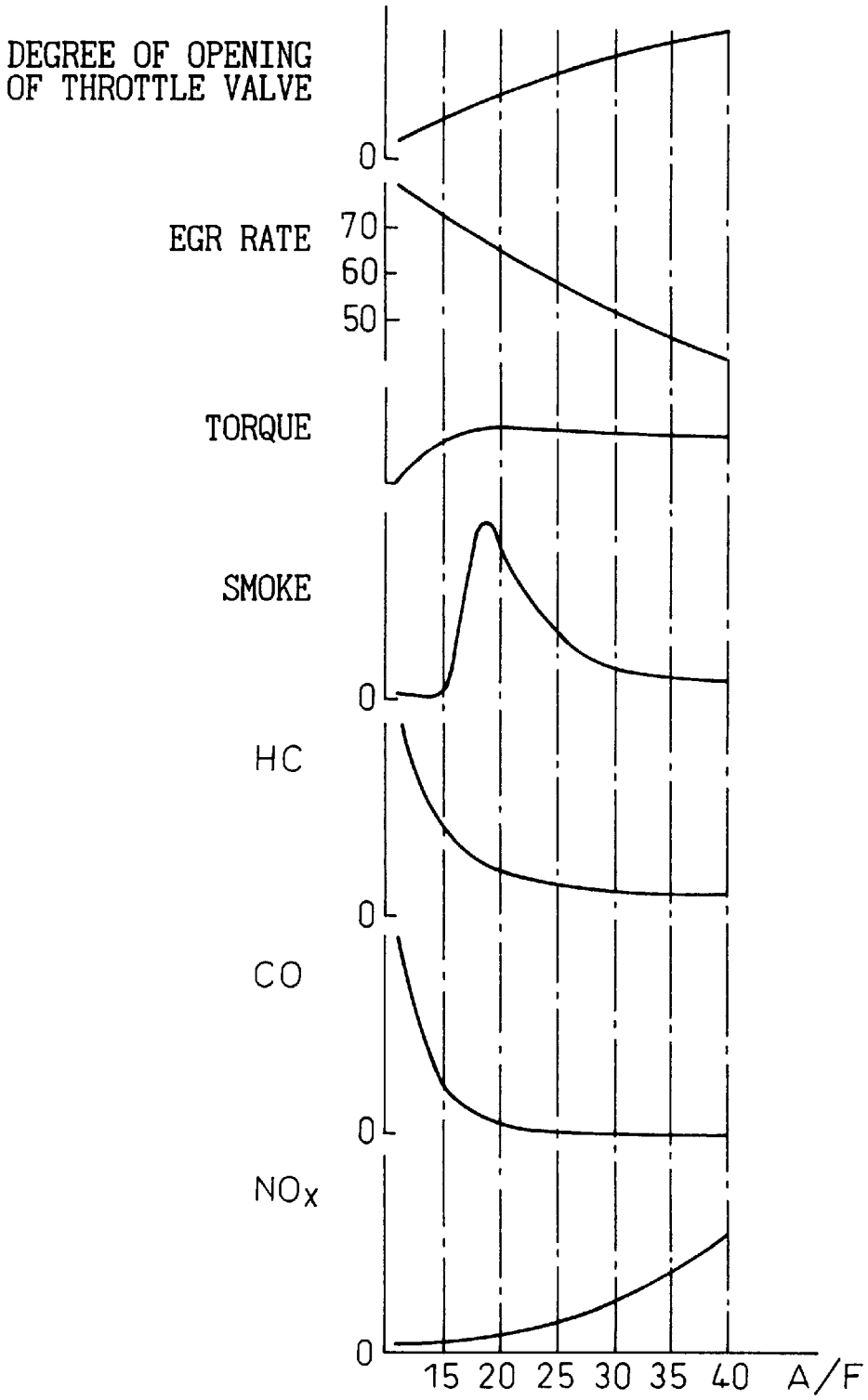
FIG. 2 is a view of the amount of generation of smoke and NOx.

FIG. 2 shows an example of an experiment showing the changes in the output torque and the changes in the amount of smoke, HC, CO, and NOx exhausted when changing the air fuel ratio A/F (abscissa in FIG. 2) by changing the opening degree of the throttle valve 16 and the EGR rate at the time of engine low load operation. As will be understood from FIG. 2, in this experiment, the EGR rate becomes larger the smaller the air fuel ratio A/F. When below the stoichiometric air fuel ratio (=14.6), the EGR rate becomes over 70 percent.

As shown in FIG. 2, if increasing the EGR rate to reduce the air fuel ratio A/F, when the EGR rate becomes close to 50 percent and the air fuel ratio A/F becomes 30 degrees, the amount of smoke produced starts to increase. Next, when the EGR rate is further raised and the air fuel ratio A/F is made smaller, the amount of smoke produced sharply increases and peaks. Next, when the EGR rate is further raised and the air-fuel ratio A/F is made smaller, the smoke sharply falls. When the EGR rate is made over 70 percent and the air fuel ratio A/F becomes close to 15.0, the smoke produced becomes substantially zero. That is, almost no soot is produced any longer. At this time, the output torque of the engine falls somewhat and the amount of NOx produced becomes considerably lower. On the other hand, at this time, the amounts of HC and CO produced start to increase.

Figure 3A:
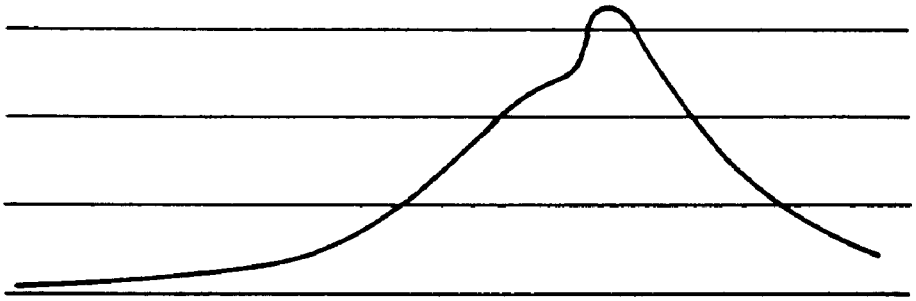
FIGS. 3A and 3B are views of the combustion pressure.
Figure 3B:
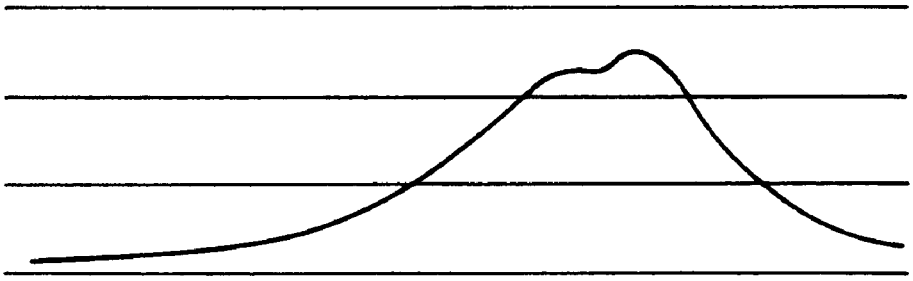

FIG. 3A shows the changes in compression pressure in the combustion chamber 5 when the amount of smoke produced is the greatest near an air fuel ratio A/F of 21. FIG. 3B shows the changes in compression pressure in the combustion chamber 5 when the amount of smoke produced is substantially zero near an air fuel ratio A/F of 18. As will be understood from a comparison of FIG. 3A and FIG. 3B, the combustion pressure is lower in the case shown in FIG. 3B where the amount of smoke produced is substantially zero than the case shown in FIG. 3A where the amount of smoke produced is large.

The following may be said from the results of the experiment shown in FIG. 2 and FIGS. 3A and 3B. That is, first, when the air fuel ratio A/F is less than 15.0 and the amount of smoke produced is substantially zero, the amount of NOx produced falls considerably as shown in FIG. 2. The fact that the amount of NOx produced falls means that the combustion temperature in the combustion chamber 5 falls. Therefore, it can be said that when almost no soot is produced, the combustion temperature in the combustion chamber 5 becomes lower. The same thing may be said from FIGS. 3A and 3B. That is, in the state shown in FIG. 3B where almost no soot is produced, the combustion pressure becomes lower, therefore the combustion temperature in the combustion chamber 5 becomes lower at this time.

Figure 4:
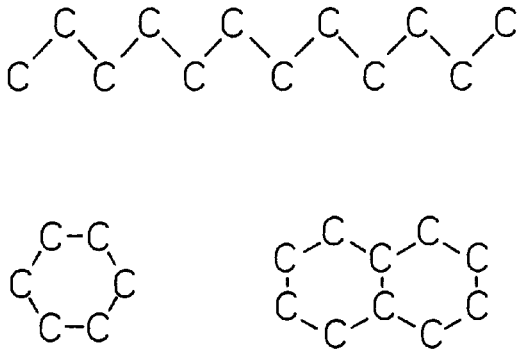
FIG. 4 is a view of a fuel molecule.

Second, when the amount of smoke produced, that is, the amount of soot produced, becomes substantially zero, as shown in FIG. 2, the amounts of HC and CO exhausted increase. This means that the hydrocarbons are exhausted without growing into soot. That is, the straight chain hydrocarbons and aromatic hydrocarbons contained in the fuel and shown in FIG. 4 decompose when raised in temperature in an oxygen poor state resulting in the formation of a precursor of soot. Next, soot mainly comprised of solid masses of carbon atoms is produced. In this case, the actual process of production of soot is complicated. How the precursor of soot is formed is not clear, but whatever the case, the hydrocarbons shown in FIG. 4 grow to soot through the soot precursor. Therefore, as explained above, when the amount of production of soot becomes substantially zero, the amount of exhaust of HC and CO increases as shown in FIG. 2, but the HC at this time is a soot precursor or a state of hydrocarbons before that.

Summarizing these considerations based on the results of the experiments shown in FIG. 2 and FIGS. 3A and 3B, when the combustion temperature in the combustion chamber 5 is low, the amount of soot produced becomes substantially zero. At this time, a soot precursor or a state of hydrocarbons before that is exhausted from the combustion chamber 5. More detailed experiments and studies were conducted on this. As a result, it was learned that when the temperatures of the fuel and the gas around the fuel in the combustion chamber 5 are below a certain temperature, the process of growth of soot stops midway, that is, no soot at all is produced and that when the temperature of the fuel and its surroundings in the combustion chamber 5 becomes higher than a certain temperature, soot is produced.

The temperature of the fuel and its surroundings when the process of production of hydrocarbons stops in the state of the soot precursor, that is, the above certain temperature, changes depending on various factors such as the type of the fuel, the air fuel ratio, and the compression ratio, so it cannot be said what degree it is, but this certain temperature is deeply related with the amount of production of NOx. Therefore, this certain temperature can be defined to a certain degree from the amount of production of NOx. That is, the greater the EGR rate, the lower the temperature of the fuel and the gas surrounding it at the time of combustion and the lower the amount of NOx produced. At this time, when the amount of NOx produced becomes around 10 ppm or less, almost no soot is produced any more. Therefore, the above certain temperature substantially matches the temperature when the amount of NOx produced becomes 10 ppm or less.

Once soot is produced, it is impossible to remove it by after-treatment using an oxidation catalyst etc. As opposed to this, a soot precursor or a state of hydrocarbons before this can be easily removed by after-treatment using an oxidation catalyst etc. Considering after-treatment by an oxidation catalyst etc., there is an extremely great difference between whether the hydrocarbons are exhausted from the combustion chamber 5 in the form of a soot precursor or a state before that or exhausted from the combustion chamber 5 in the form of soot. The new combustion system used in the present invention is based on the idea of exhausting the hydrocarbons from the combustion chamber 5 in the form of a soot precursor or a state before that without allowing the production of soot in the combustion chamber 5 and causing the hydrocarbons to oxidize by an oxidation catalyst etc.

Now, to stop the growth of hydrocarbons in the state before the production of soot, it is necessary to suppress the temperatures of the fuel and the gas around it at the time of combustion in the combustion chamber 5 to a temperature lower than the temperature where soot is produced. In this case, it was learned that the heat absorbing action of the gas around the fuel at the time of combustion of the fuel has an extremely great effect in suppression of the temperatures of the fuel and the gas around it.

That is, if there is only air around the fuel, the vaporized fuel will immediately react with the oxygen in the air and burn. In this case, the temperature of the air away from the fuel does not rise that much. Only the temperature around the fuel becomes locally extremely high. That is, at this time, the air away from the fuel does not absorb the heat of combustion of the fuel much at all. In this case, since the combustion temperature becomes extremely high locally, the unburned hydrocarbons receiving the heat of combustion produce soot.

On the other hand, when there is fuel in a mixed gas of a large amount of inert gas and a small amount of air, the situation is somewhat different. In this case, the evaporated fuel disperses in the surroundings and reacts with the oxygen mixed in the inert gas to burn. In this case, the heat of combustion is absorbed by the surrounding inert gas, so the combustion temperature no longer rises that much. That is, it becomes possible to keep the combustion temperature low. That is, the presence of inert gas plays an important role in the suppression of the combustion temperature. It is possible to keep the combustion temperature low by the heat absorbing action of the inert gas.

In this case, to suppress the temperatures of the fuel and the gas around it to a temperature lower than the temperature at which soot is produced, an amount of inert gas enough to absorb an amount of heat sufficient for lowering the temperatures is required. Therefore, if the amount of fuel increases, the amount of inert gas required increases along with the same. Note that in this case the larger the specific heat of the inert gas, the stronger the heat absorbing action. Therefore, the inert gas is preferably a gas with a large specific heat. In this regard, since $CO_2$ and EGR gas have relatively large specific heats, it may be said to be preferable to use EGR gas as the inert gas.

Figure 5:
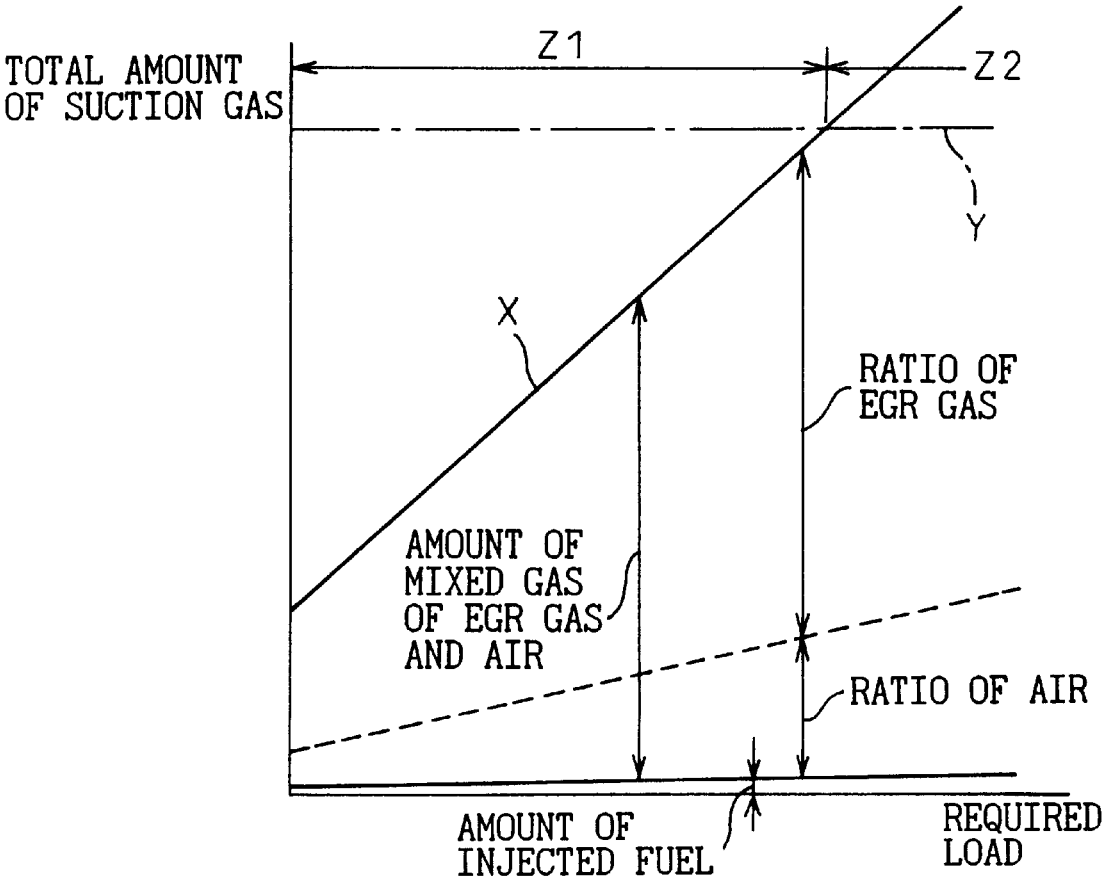
FIG. 5 is a view of the relationship between the amount of injected fuel and the amount of mixed gas.

FIG. 5 shows the amount of mixed gas of EGR gas and air, the ratio of air in the mixed gas, and the ratio of EGR gas in the mixed gas required for making the temperatures of the fuel and the gas around it at the time of combustion a temperature lower than the temperature at which soot is produced in the case of use of EGR gas as an inert gas. Note that in FIG. 5, the ordinate shows the total amount of suction gas taken into the combustion chamber 5. The broken line Y shows the total amount of suction gas able to be taken into the combustion chamber 5 when supercharging is not being performed. Further, the abscissa shows the required load. Z1 shows the low load operating region.

Referring to FIG. 5, the ratio of air, that is, the amount of air in the mixed gas, shows the amount of air necessary for causing the injected fuel to completely burn. That is, in the case shown in FIG. 5, the ratio of the amount of air and the amount of injected fuel becomes the stoichiometric air fuel ratio. On the other hand, in FIG. 5, the ratio of EGR gas, that is, the amount of EGR gas in the mixed gas, shows the minimum amount of EGR gas required for making the temperatures of the fuel and the gas around it a temperature lower than the temperature at which soot is produced. This amount of EGR gas is, expressed in terms of the EGR rate, about at least 70 percent. That is, if the total amount of suction gas taken into the combustion chamber 5 is made the solid line X in FIG. 5 and the ratio between the amount of air and amount of EGR gas in the total amount of suction gas X is made the ratio shown in FIG. 5, the temperatures of the fuel and the gas around it becomes a temperature lower than the temperature at which soot is produced and therefore no soot at all is produced any longer. Further, the amount of NOx produced at this time is around 10 ppm or less and therefore the amount of NOx produced becomes extremely small.

If the amount of fuel injected increases, the amount of heat generated at the time of combustion increases, so to maintain the temperatures of the fuel and the gas around it at a temperature lower than the temperature at which soot is produced, the amount of heat absorbed by the EGR gas must be increased. Therefore, as shown in FIG. 5, the amount of EGR gas has to be increased the greater the amount of injected fuel. That is, the amount of EGR gas has to be increased as the required load becomes higher.

On the other hand, in the load region Z2 of FIG. 5, the total amount of suction gas X required for inhibiting the production of soot exceeds the total amount of suction gas Y which can be taken in. Therefore, in this case, to supply the total amount of suction gas X required for inhibiting the production of soot into the combustion chamber 5, it is necessary to supercharge or pressurize both of the EGR gas and the suction gas or the EGR gas. When not supercharging or pressurizing the EGR gas etc., in the load region Z2, the total amount of suction gas X matches with the total amount of suction gas Y which can be taken in. Therefore, in the case, to inhibit the production of soot, the amount of air is reduced somewhat to increase the amount of EGR gas and the fuel is made to burn in a state where the air fuel ratio is rich.

As explained above, FIG. 5 shows the case of combustion of fuel at the stoichiometric air fuel ratio. In the low load operating region Z1 shown in FIG. 5, even if the amount of air is made smaller than the amount of air shown in FIG. 5, that is, even if the air fuel ratio is made rich, it is possible to obstruct the production of soot and make the amount of NOx produced around 10 ppm or less. Further, in the low load region Z1 shown in FIG. 5, even if the amount of air is made greater than the amount of air shown in FIG. 5, that is, the mean value of the air fuel ratio is made lean, it is possible to obstruct the production of soot and make the amount of NOx produced around 10 ppm or less.

That is, when the air fuel ratio is made rich, the fuel becomes in excess, but since the fuel temperature is suppressed to a low temperature, the excess fuel does not grow into soot and therefore soot is not produced. Further, at this time, only an extremely small amount of NOx is produced. On the other hand, when the mean air fuel ratio is lean or when the air fuel ratio is the stoichiometric air fuel ratio, a small amount of soot is produced if the combustion temperature becomes higher, but in the present invention, the combustion temperature is suppressed to a low temperature, so no soot at all is produced. Further, only an extremely small amount of NOx is produced.

In this way, in the engine low load operating region Z1, regardless of the air fuel ratio, that is, whether the air fuel ratio is rich or the stoichiometric air fuel ratio or the mean air fuel ratio is lean, no soot is produced and the amount of NOx produced becomes extremely small. Therefore, considering the improvement of the fuel efficiency, it may be said to be preferable to make the mean air fuel ratio lean.

It is however only possible to suppress the temperature of the fuel and the gas surrounding it at the time of combustion in the combustion chamber to less than the temperature where the growth of the hydrocarbons is stopped midway at the time of a relatively low engine load where the amount of heat generated by the combustion is small. Accordingly, in the present invention, when the engine load is relatively low, the temperature of the fuel and the gas surrounding it is suppressed to less than the temperature where the growth of the hydrocarbons stops midway and first combustion, that is, low temperature combustion, is performed. When the engine load is relatively high, second combustion, that is, the conventionally normally performed combustion, is performed. Note that the first combustion, that is, the low temperature combustion, as clear from the explanation up to here, means combustion where the amount of inert gas in the combustion chamber is larger than the amount of inert gas where the amount of production of the soot peaks and where almost no soot is produced, while the second combustion, that is, the conventionally normally performed combustion, means combustion where the amount of inert gas in the combustion chamber is smaller than the amount of inert gas where the amount of production of soot peaks.

Figure 6:
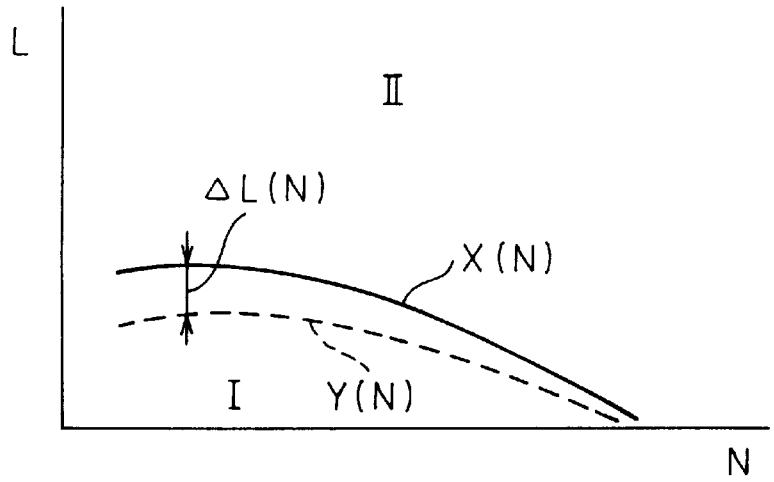
FIG. 6 is a view of a first operating region I and a second operating region II.

FIG. 6 shows a first operating region I where the first combustion, that is, the low temperature combustion, is performed and a second operating region II where the second combustion, that is, the combustion by the conventional combustion method, is performed. Note that in FIG. 6, the abscissa L shows the amount of depression of the accelerator pedal 40, that is, the required load, and the ordinate N shows the engine rotational speed. Further, in FIG. 6, X(N) shows a first boundary between the first operating region I and the second operating region II, and Y(N) shows a second boundary between the first operating region I and the second operating region II. The change of operating regions from the first operating region I to the second operating region II is judged based on the first boundary X(N), while the change of operating regions from the second operating region II to the first operating region I is judged based on the second boundary Y(N).

That is, when low temperature combustion is being performed when the engine is operating in the first operating region I, if the required load L exceeds the first boundary X(N), which is a function of the engine rotational speed N, it is judged that the operating region has shifted to the second operating region II and combustion by the conventional method of combustion is performed. Next, when the required load L becomes lower than the second boundary Y(N), which is a function of the engine rotational speed N, it is judged that the operating region has shifted to the first operating region I and low temperature combustion is again performed.

Figure 7:
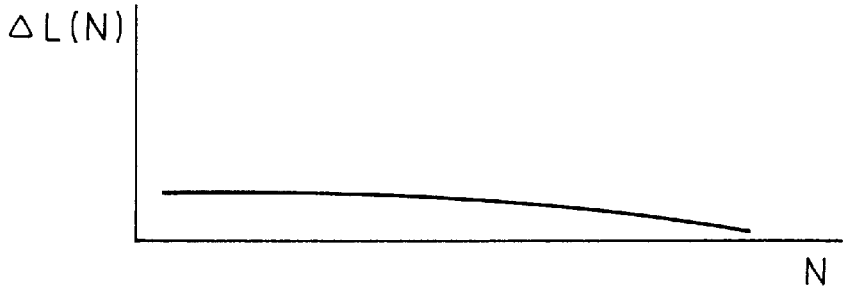
FIG. 7 is a view of the relationship between ΔL(N) and the engine rotational speed N.

Note that in this embodiment of the present invention, the second boundary Y(N) is made the low load side from the first boundary X(N) by exactly ΔL(N). As shown in FIG. 6 and FIG. 7, ΔL(N) is a function of the engine rotational speed N. ΔL(N) becomes smaller the higher the engine rotational speed N.

When low temperature combustion is being performed when the engine is operating in the first operating region I, almost no soot is produced, but instead the unburnt hydrocarbons are exhausted from the combustion chamber 5 in the form of a soot precursor or a sate before that. At this time, if the catalyst 19 having the oxidation function is activated, the unburnt hydrocarbons exhausted from the combustion chamber 5 may be oxidized well by the catalyst 19. When the catalyst 19 is not activated at this time, however, the unburnt hydrocarbons cannot be oxidized by the catalyst 19 and therefore a large amount of unburnt hydrocarbons are exhausted into the atmosphere. Accordingly, in the present invention, even when the engine operating state is the first operating region where the first combustion, that is, low temperature combustion, can be performed, if the catalyst 19 is not activated, the first combustion is not performed, but the second combustion, that is, the combustion by the conventional method of combustion, is performed.

As the catalyst 19, an oxidation catalyst, three-way catalyst, or NOx absorbent may be used. An NOx absorbent has the function of absorbing the NOx when the mean air-fuel ratio in the combustion chamber 5 is lean and releasing the NOx when the mean air-fuel ratio in the combustion chamber 5 becomes rich. The NOx absorbent is for example comprised of alumina as a carrier and, on the carrier, for example, at least one of potassium K, sodium Na, lithium Li, cesium Cs, and other alkali metals, barium Ba, calcium Ca, and other alkali earths, lanthanum La, yttrium Y, and other rare earths plus platinum Pt or another precious metal is carried.

The oxidation catalyst, of course, and also the three-way catalyst and NOx absorbent have an oxidation function, therefore the three-way catalyst and NOx absorbent can be used as the catalyst 19 as explained above.

The catalyst 19 is activated when the temperature of the catalyst 19 exceeds a certain predetermined temperature. The temperature at which the catalyst 19 is activated differs depending on the type of the catalyst 19. The activation temperature of a typical oxidation catalyst is about 350° C. The temperature of the exhaust gas passing through the catalyst 19 is lower than the temperature of the catalyst 19 by exactly a slight predetermined temperature, therefore the temperature of the exhaust gas passing through the catalyst 19 represents the temperature of the catalyst 19. Accordingly, in the embodiment of the present invention, it is judged if the catalyst 19 has become activated from the temperature of the exhaust gas passing through the catalyst 19.

Figure 8A:
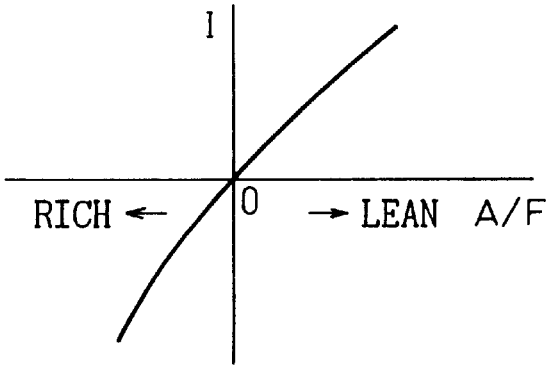
FIGS. 8A and 8B are views of the output of the air-fuel ratio sensor etc.
Figure 8B:
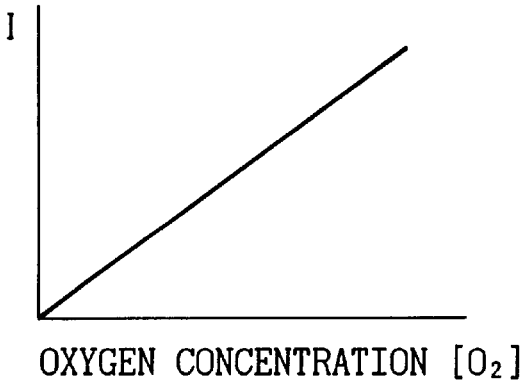

FIG. 8A shows the output of the air fuel ratio sensor 21. As shown in FIG. 8A, the output current I of the air fuel ratio sensor 21 changes in accordance with the air fuel ratio A/F. Therefore, it is possible to determine the air-fuel ratio from the output current I of the air fuel ratio sensor 21. Further, FIG. 8B shows the output of the oxygen concentration sensor 44. As shown in FIG. 8B, the output current I of the oxygen concentration sensor 44 changes in accordance with the oxygen concentration ($O_2$). Therefore, it is possible to determine the oxygen concentration from the output current I of the oxygen concentration sensor 44.

Next, a general explanation will be given of the control of the operation in the first operating region I and the second operating region II referring to FIG. 9 taking as an example a case where the catalyst 19 is activated.

Figure 9:
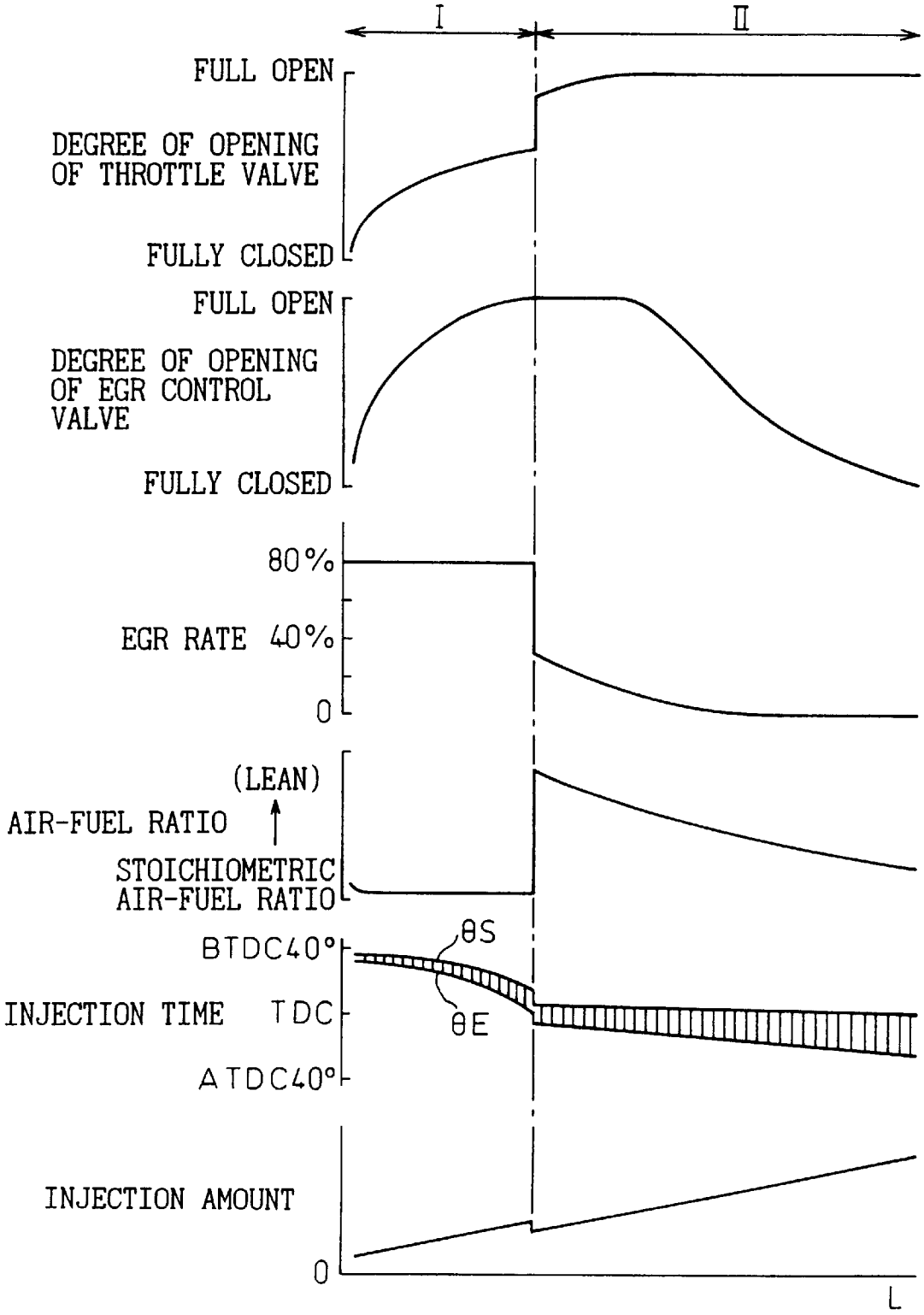
FIG. 9 is a view of the opening degree of a throttle valve etc.

FIG. 9 shows the opening degrees of the throttle valve 16, the opening degree of the EGR control valve 23, the EGR rate, the air-fuel ratio, the injection timing, and the amount of injection with respect to the required load L. As shown in FIG. 9, in the first operating region I with the low required load L, the opening degree of the throttle valve 16 is gradually increased from the fully closed state to the half opened state as the required load L becomes higher, while the opening degree of the EGR control valve 23 is gradually increased from the fully closed state to the fully opened state as the required load L becomes higher. Further, in the example shown in FIG. 9, in the first operating region I, the EGR rate is made about 80 percent and the air-fuel ratio is made a just slightly lean air-fuel ratio.

In other words, in the first operating region, the opening degree of the throttle valve 16 and the opening degree of the EGR control valve 23 are controlled so that the EGR rate becomes about 80 percent and the air-fuel ratio becomes just slightly lean. Note that at this time, the air-fuel ratio is controlled to the target air-fuel ratio by correcting the opening degree of the throttle valve 16 and the opening degree of the EGR control valve 23 based on the output signal of the air-fuel ratio sensor 21. Further, in the first operating region I, the fuel is injected before top dead center of the compression stroke TDC. In this case, the injection start timing θS becomes later the higher the required load L. The injection end timing θE also becomes later the later the injection start timing θS.

Note that, during idling operation, the throttle valve 16 is made to close to close to the fully closed state. At this time, the EGR control valve 23 is also made to close to close to the fully closed state. If the throttle valve 16 closes to close to the fully closed state, the pressure in the combustion chamber 5 at the start of compression will become low, so the compression pressure will become small. If the compression pressure becomes small, the amount of compression work by the piston 4 becomes small, so the vibration of the engine body 1 becomes smaller. That is, during idling operation, the throttle valve 16 can be closed to close to the fully closed state to suppress vibration in the engine body 1.

When the engine is operating in the first operating region I, almost no soot and NOx is produced and hydrocarbons in the form of a soot precursor or its previous state contained in the exhaust gas can be oxidized by the catalyst 19.

On the other hand, if the engine operating state changes from the first operating region I to the second operating region II, the opening degree of the throttle valve 16 is increased in a step-like manner from the half opened state to the fully opened state. At this time, in the example shown in FIG. 9, the EGR rate is reduced in a step-like manner from about 80 percent to less than 40 percent and the air-fuel ratio is increased in a step-like manner. That is, since the EGR rate jumps over the range of EGR rates (FIG. 2) where a large amount of smoke is produced, there is no longer a large amount of smoke produced when the engine operating state changes from the first operating region I to the second operating region II.

In the second operating region II, the conventionally performed combustion is performed. In this combustion method, some soot and NOx are produced, but the heat efficiency is higher than with the low temperature combustion, so if the engine operating state changes from the first operating region I to the second operating region II, the amount of injection is reduced in a step-like manner as shown in FIG. 9.

In the second operating region II, the throttle valve 16 is held in the fully opened state except in portions and the opening degree of the EGR control valve 23 is gradually made smaller then higher the required load L. Therefore, in the operating region II, the EGR rate becomes lower the higher the required load L and the air-fuel ratio becomes smaller the higher then required load L. Even if the required load L becomes high, however, the air-fuel ratio is made a lean air-fuel ratio. Further, in the second operating region II, the injection start timing θS is made close to top dead center of the compression stroke TDC.

The range of the first operating region I where low temperature combustion is possible changes according to the temperature of the gas in the combustion chamber 5 at the start of compression and the temperature of the surface of the inside wall of the cylinder. That is, if the required load becomes high and the amount of heat generated due to the combustion increases, the temperature of the fuel and its surrounding gas at the time of combustion becomes high and therefore low temperature combustion can no longer be performed. On the other hand, when the temperature of the gas TG in the combustion chamber 5 at the start of compression becomes low, the temperature of the gas in the combustion chamber 5 directly before when the combustion was started becomes lower, so the temperature of the fuel and its surrounding gas at the time of combustion becomes low. Accordingly, if the temperature of the gas TG in the combustion chamber 5 at the start of compression becomes low, even if the amount of heat generated by the combustion increases, that is, even if the required load becomes high, the temperature of the fuel and its surrounding gas at the time of combustion does not become high and therefore low temperature combustion is performed. In other words, the lower the temperature of the gas TG in the combustion chamber 5 at the start of compression, the more the first operating region I where low temperature combustion can be performed expands to the high load side.

Further, the smaller the temperature difference (TW−TG) between the temperature TW of the cylinder inner wall and the temperature of the gas TG in the combustion chamber 5 at the start of compression, the more the amount of heat escaping through the cylinder inner wall during the compression stroke. Therefore, the smaller this temperature difference (TW−TG), the smaller the amount of rise of temperature of the gas in the combustion chamber 5 during the compression stroke and therefore the lower the temperature of the fuel and its surrounding gas at the time of combustion. Accordingly, the smaller the temperature difference (TW−TG), the more the first operating region I where low temperature combustion can be performed expands to the high load side.

Figure 10:
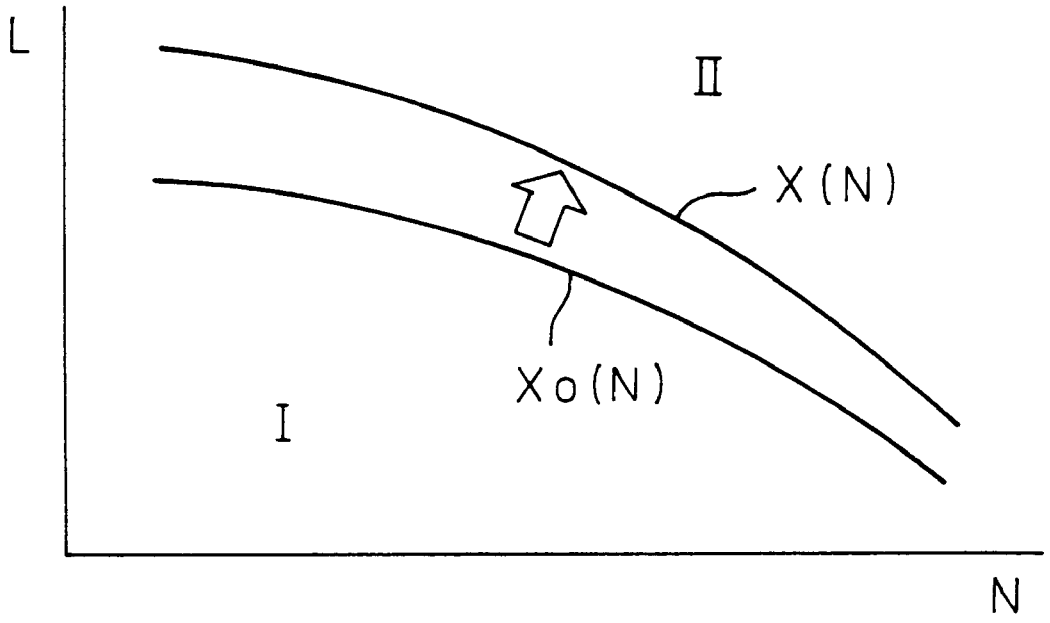
FIG. 10 is a view explaining the method of control of a first boundary X(N)

In this embodiment according to the present invention, when the temperature of the gas TG in the combustion chamber 5 becomes low, as shown in FIG. 10, the first boundary is made to shift from $X_0(N)$ to X(N). When the temperature difference (TW−TG) becomes small, as shown in FIG. 10, the first boundary is made to shift from $X_0(N)$ to X(N). Note that here, $X_0(N)$ shows the reference first boundary. The reference first boundary $X_0(N)$ is a function of the engine rotational speed N. X(N) is calculated using this $X_0(N)$ based on the following equations:

$$X(N)=X_0(N)+K(T)\cdot K(N)$$

$$K(T)=K(T)_1+K(T)_2$$

Figure 11A:
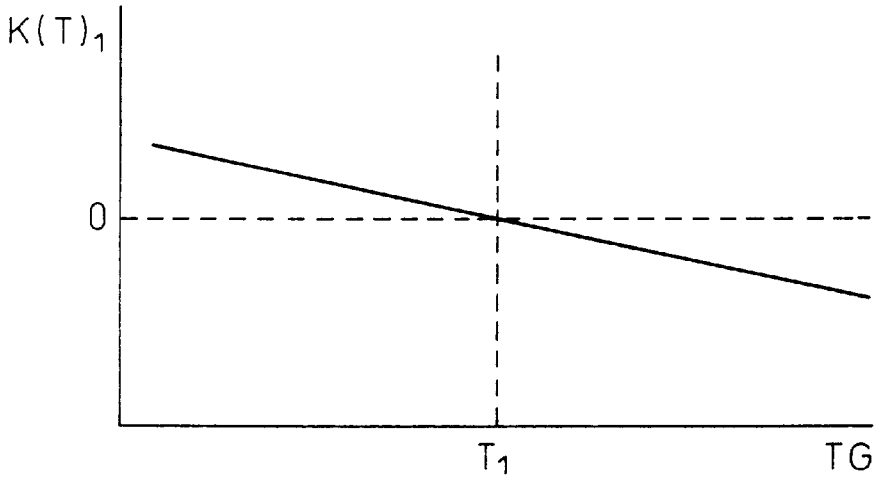
FIGS. 11A to 11C are views of $K(T)_1$, $K(T)_2$, and K(N)
Figure 11B:
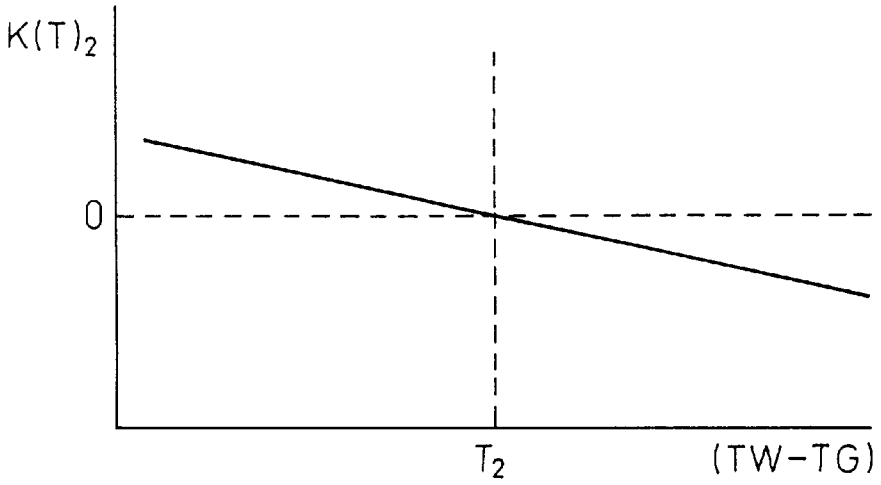

Here, $K(T)_1$, as shown in FIG. 11A, is a function of the temperature of the gas TG in the combustion chamber 5 at the start of compression. The value of $K(T)_1$ becomes larger the lower the temperature of the gas TG in the combustion chamber 5 at the start of compression. Further, $K(T)_2$ is a function of the temperature difference (TW−TG) as shown in FIG. 11B. The value of $K(T)_2$ becomes larger the smaller the temperature difference (TW−TG). Note that in FIG. 11A and FIG. 11B, $T_1$ is the reference temperature and $T_2$ is the reference temperature difference. When TG=$T_1$ and (TW−TG)=$T_2$, the first boundary becomes $X_0(N)$ of FIG. 10.

Figure 11C:
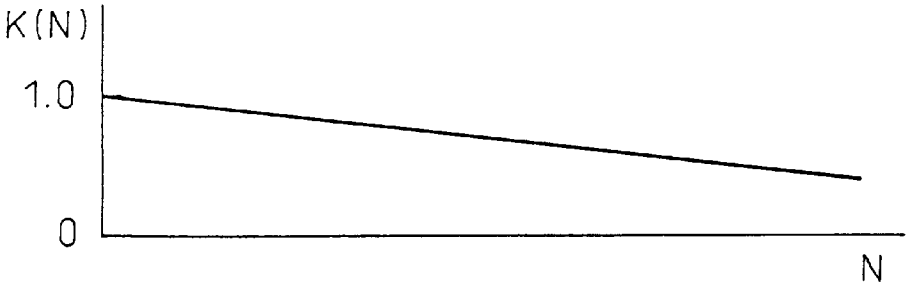

On the other hand, K(N) is a function of the engine rotational speed N as shown in FIG. 11C. The value of K(N) becomes smaller the higher the engine rotational speed N. That is, when the temperature of the gas TG in the combustion chamber 5 at the start of compression becomes lower than the reference temperature $T_1$, the lower the temperature of the gas TG in the combustion chamber 5 at the start of compression, the more the first boundary X(N) shifts to the high load side with respect to $X_0(N)$. When the temperature difference (TW−TG) becomes lower than the reference temperature difference $T_2$, the smaller the temperature difference (TW−TG), the more the first boundary X(N) shifts to the high load side with respect to $X_0(N)$. Further, the amount of shift of X(N) with respect to $X_0(N)$ becomes smaller the higher the engine rotational speed N.

Figure 12A:
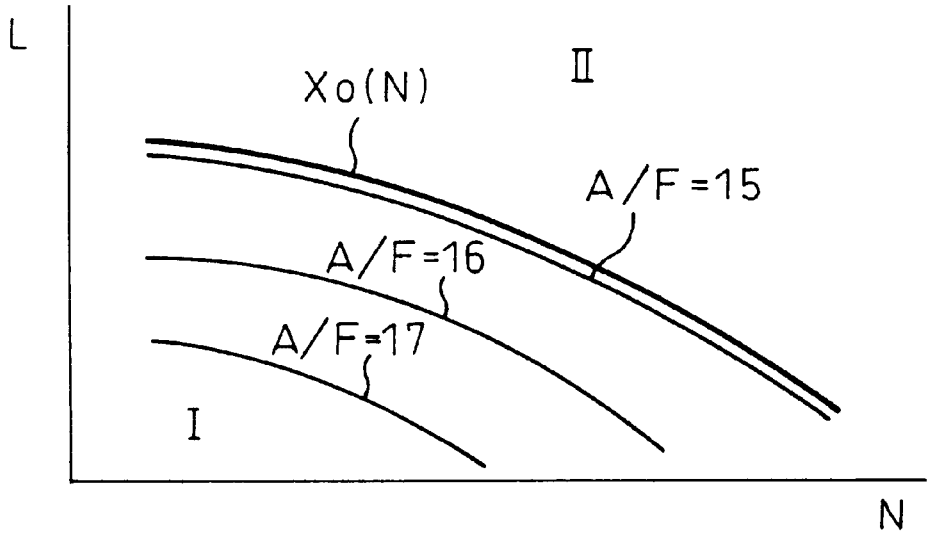
FIGS. 12A and 12B are views of the air-fuel ratio in the first operating region I.

FIG. 12A shows the air-fuel ratio A/F in the first operating region I when the first boundary is the reference first boundary $X_0(N)$. In FIG. 12A, the curves shown by A/F=15, A/F=16, and A/F=17 respectively show the cases where the air-fuel ratio is 15, 16, and 17. The air-fuel ratios between the curves are determined by proportional distribution. As shown in FIG. 12A, in the first operating region, the air-fuel ratio becomes lean. Further, in the first operating region I, the air-fuel ratio A/F is made leaner the lower the required load L.

That is, the lower the required load L, the smaller the amount of heat generated by the combustion. Accordingly, the lower the required load L, the more low temperature combustion can be performed even if the EGR rate is lowered. If the EGR rate is lowered, the air-fuel ratio becomes larger. Therefore, as shown in FIG. 12A, the air-fuel ratio A/F is made larger as the required load L becomes lower. The larger the air-fuel ratio A/F becomes, the more improved the fuel efficiency. Therefore to make the air-fuel ratio as lean as possible, in the embodiment according to the present invention, the air-fuel ratio A/F is made larger the lower the required load L becomes.

Figure 12B:
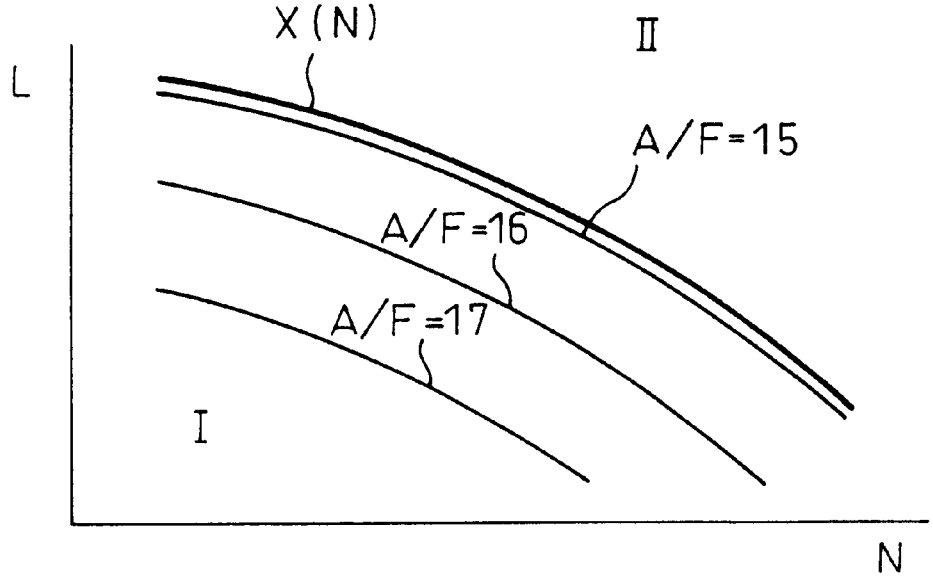

FIG. 12B shows the air-fuel ratio A/F in the first operating region I when the first boundary is X(N) shown in FIG. 10. If comparing FIG. 12A and FIG. 12B, when the first boundary X(N) shifts to the high load side with respect to $X_0(N)$, the curves of A/F=15, A/F=16, and A/F=17 showing the air-fuel ratios also shift to the high load side following the same. Therefore, it is learned that when the first boundary X(N) shifts to the high load side with respect to $X_0(N)$, the air-fuel ratio A/F at the same required load L and the same engine rotational speed N becomes larger. That is, if the first operating region I is made to expand to the high load side, not only is the operating region where almost no soot and NOx are produced expanded, but also the fuel efficiency is improved.

In this embodiment according to the present invention, the target air-fuel ratios in the first operating region I for various different first boundaries X(N), that is, the target air-fuel ratios in the first operating region I for various values of K(T), are stored in advance in the ROM 32 in the form of a map as a function of the required load L and the engine rotational speed N as shown in FIG. 13A to FIG. 13D. That is, FIG. 13A shows the target air-fuel ratio AFKT1 when the value of K(T) is KT1, FIG. 13B shows the target air-fuel ratio AFKT2 when the value of K(T) is KT2, FIG. 13C shows the target air-fuel ratio AFKT3 when the value of K(T) is KT3, and FIG. 13D shows the target air-fuel ratio AFKT4 when the value of K(T) is KT4.

On the other hand, the target opening degrees of the throttle valve 16 required for making the air-fuel ratio the target air-fuel ratios AFKT1, AFKT2, AKFT3, and AFKT4 are stored in advance in the ROM 32 in the form of a map as a function of the required load L and the engine rotational speed N as shown in FIG. 14A to FIG. 14D. Further, the target basic opening degrees of the EGR control valve 23 required for making the air-fuel ratio the target air-fuel ratios AFKT1, AFKT2, AKFT3, and AFKT4 are stored in advance in the ROM 32 in the form of a map as a function of the required load L and the engine rotational speed N as shown in FIG. 15A to FIG. 15D.

Figure 14A:
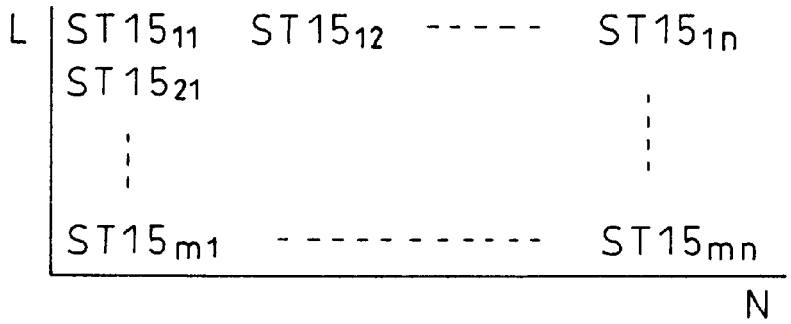
FIGS. 14A to 14D are views of a map of a target opening degree of a throttle valve.

That is, FIG. 14A shows the target opening degree ST15 of the throttle valve 16 when the air-fuel ratio is 15, while FIG. 15A shows the target basic opening degree SE15 of the EGR control valve 23 when the air-fuel ratio is 15.

Figure 14B:
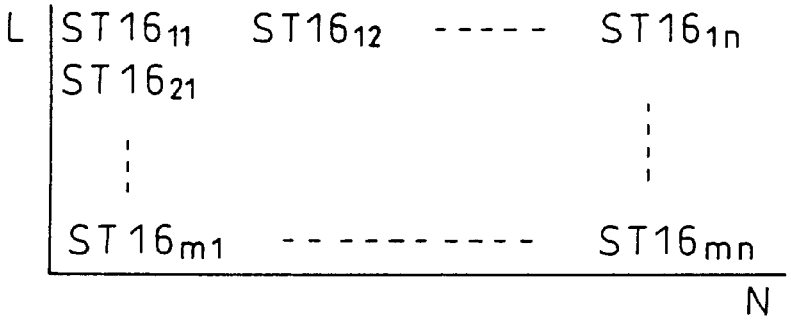

Further, FIG. 14B shows the target opening degree ST16 of the throttle valve 16 when the air-fuel ratio is 16, while FIG. 15B shows the target basic opening degree SE16 of the EGR control valve 23 when the air-fuel ratio is 16.

Figure 14C:
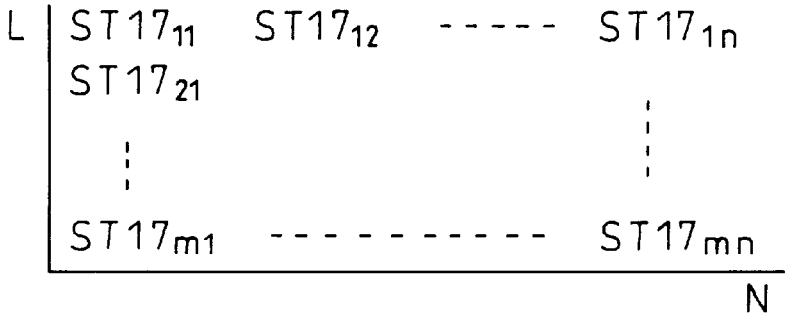

Further, FIG. 14C shows the target opening degree ST17 of the throttle valve 16 when the air-fuel ratio is 17, while FIG. 15C shows the target basic opening degree SE17 of the EGR control valve 23 when the air-fuel ratio is 17.

Figure 14D:
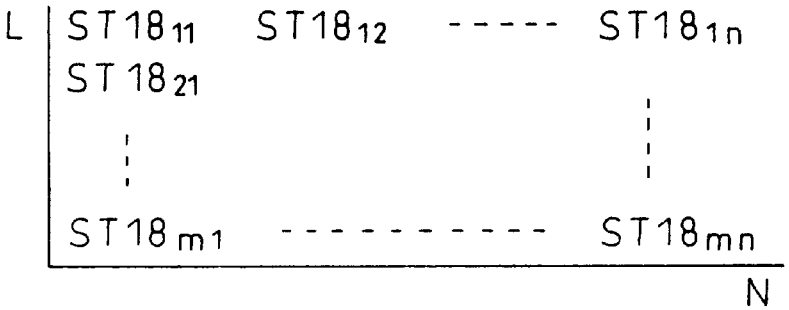

Further, FIG. 14D shows the target opening degree ST18 of the throttle valve 16 when the air-fuel ratio is 18, while FIG. 15D shows the target basic opening degree SE18 of the EGR control valve 23 when the air-fuel ratio is 18.

Figure 16:
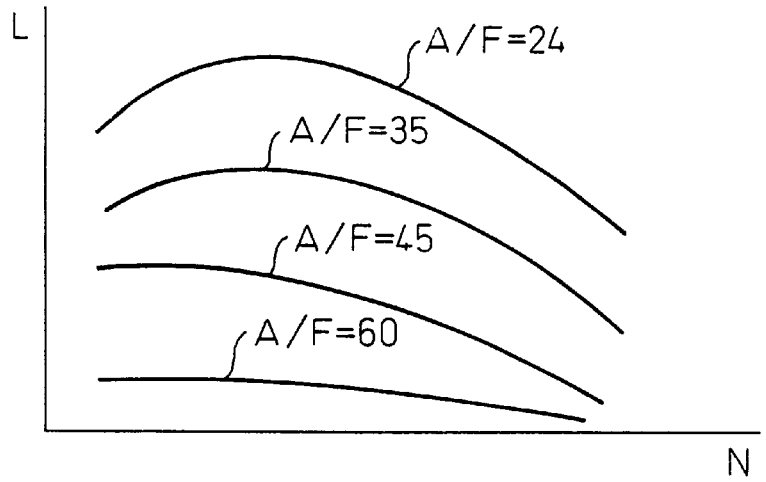
FIG. 16 is a view of an air-fuel ratio in a second combustion etc.
Figure 17A:
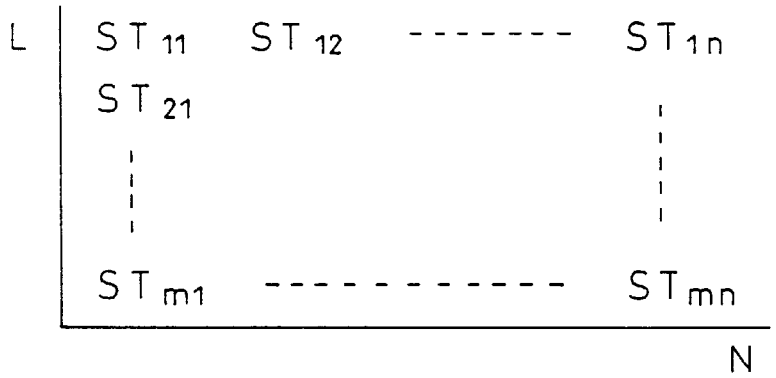
FIGS. 17A and 17B are views of a target opening degree of a throttle valve etc.
Figure 17B:
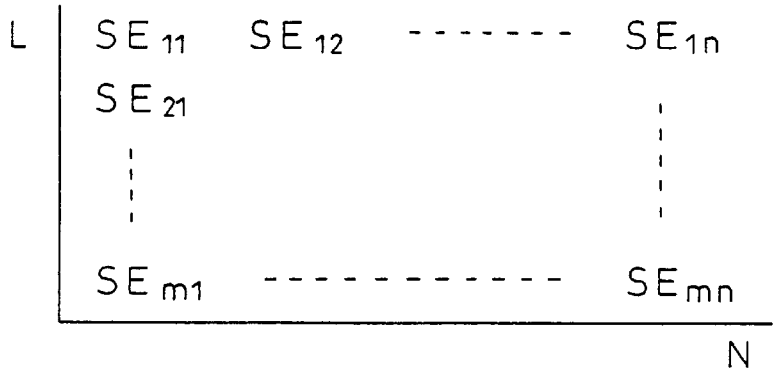

FIG. 16 shows the target air-fuel ratio at the time of second combustion, that is, normal combustion by the conventional combustion method. Note that in FIG. 16, the curves indicated by A/F=24, A/F=35, A/F=45, and A/F=60 respectively show the target air-fuel ratios 24, 35, 45, and 60. The target opening degrees ST of the throttle valve 16 required for making the air-fuel ratio these target air-fuel ratios are stored in advance in the ROM 32 in the form of a map as a function of the required load L and the engine rotational speed N as shown in FIG. 17A. The target opening degrees SE of the EGR control valve 23 required for making the air-fuel ratio these target air-fuel ratios are stored in advance in the ROM 32 in the form of a map as a function of the required load L and the engine rotational speed N as shown in FIG. 17B.

As explained up to here, when the engine is operating in the first operating region I and the catalyst 19 is activated, first combustion, that is, low temperature combustion, is performed. Sometimes however even if the engine is operating in the first operating region I and the catalyst 19 is activated, good low temperature combustion is not possible due to some reason or another. Therefore, in the first embodiment of the present invention, when the catalyst 19 is activated, when the engine is operating in the first operating region I, the opening degree of the throttle valve 16 and the opening degree of the EGR control valve 23 for the low temperature combustion are respectively made the target opening degree ST shown in FIGS. 14A to 14D and the target basic opening degree SE shown in FIGS. 15A to 15D. When good low temperature combustion is not possible at this time, that is, when defective combustion occurs, the air-fuel ratio is made larger. If the air-fuel ratio is made larger, the concentration of the oxygen around the fuel becomes higher and therefore good low temperature combustion is performed.

Figure 18:
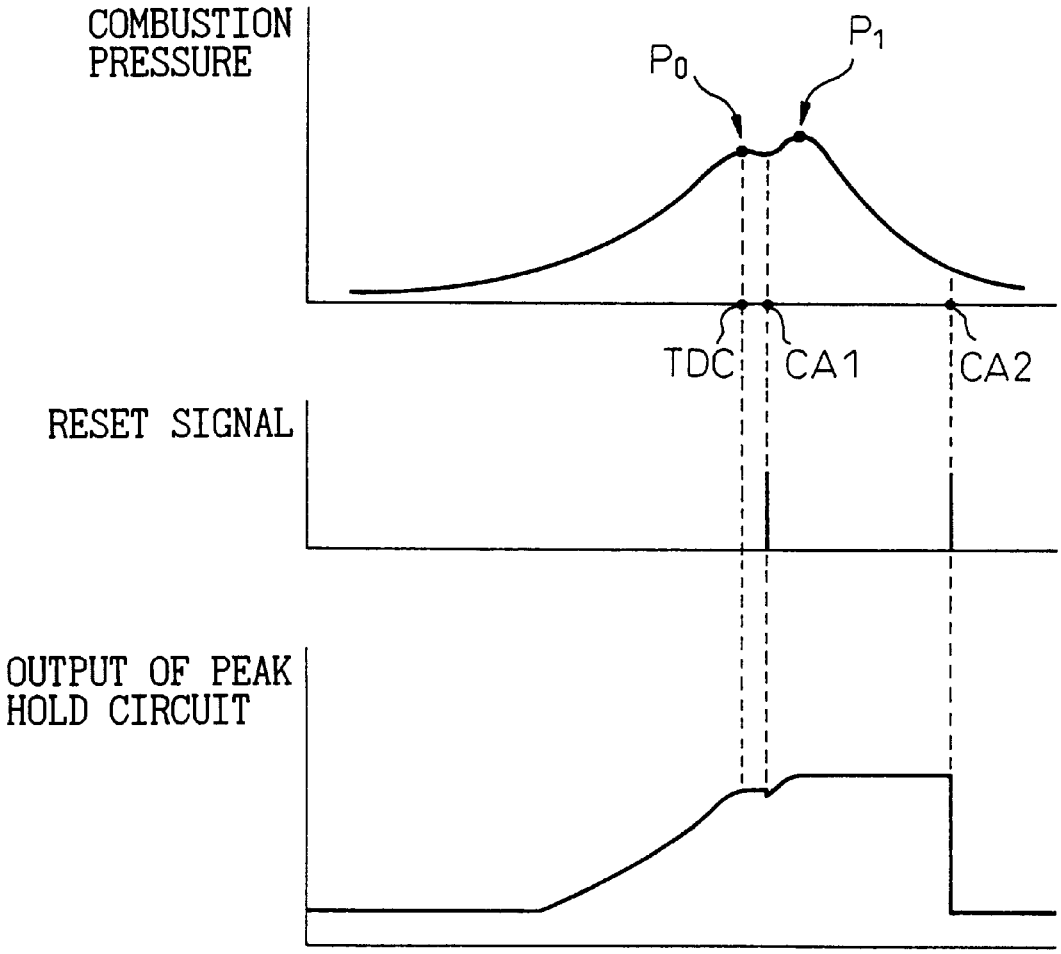
FIG. 18 is a view of a combustion pressure etc.

In the first embodiment of the present invention, whether or not good low temperature is being performed is judged based on the pressure in the combustion chamber 5 detected by the combustion pressure sensor 47. That is, when good low temperature combustion is being performed, as shown in FIG. 18, the combustion pressure changes gently. More specifically, the combustion pressure peaks once at the top dead center TDC as shown by $P_0$, then again peaks after the top dead center TDC as shown by $P_1$. The peak pressure $P_1$ occurs due to the combustion pressure. When good low temperature combustion is being performed, the peak pressure $P_1$ becomes somewhat higher than the peak pressure $P_0$.

As opposed to this, when good low temperature combustion is not being performed and defective combustion occurs, the peak pressure $P_1$ becomes lower than the peak pressure $P_0$. Therefore, in the first embodiment of the present invention, when the differential pressure $\Delta P$ $(=P_1-P_0)$ becomes a negative value, it is judged that defective combustion has occurred and the air-fuel ratio is made larger.

Figure 19:
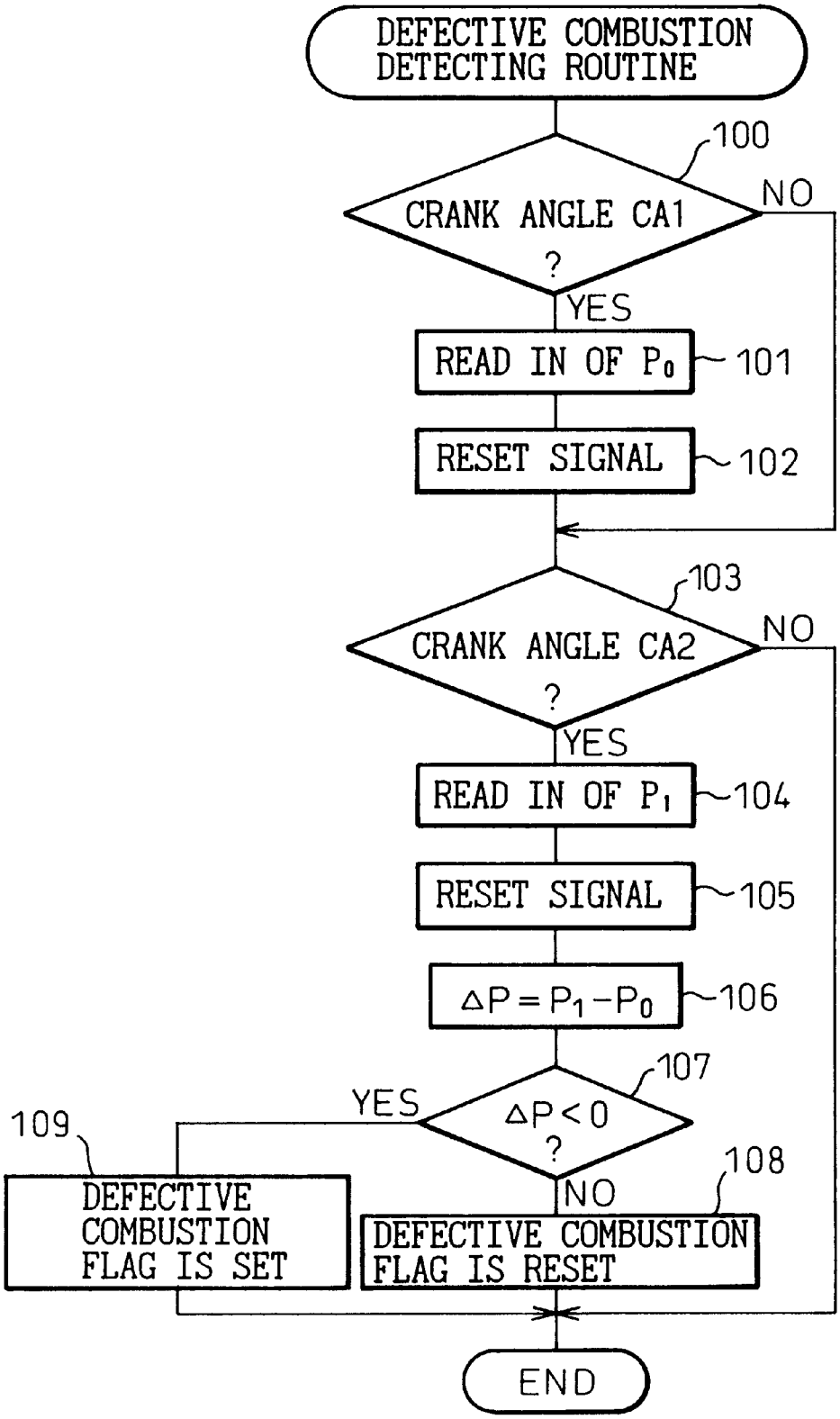
FIG. 19 is a view of a routine for detection of defective combustion.

Next, the method of detection of defective combustion will be explained with reference to FIG. 18 and FIG. 19. FIG. 19 shows the routine for detection of defective combustion. This routine is executed by crank angle interruption. Referring to FIG. 19, first, at step 100, it is judged if the current crank angle is CA1 (FIG. 18) or not. When the crank angle is CA1, the routine proceeds to step 101, where the output voltage of the peak hold circuit 48 is read. At this time, the output voltage of the peak hold circuit 48 indicates the peak pressure $P_0$, therefore at step 101, the peak pressure $P_0$ is read. Next, at step 102, the reset signal is input to the reset input terminal R of the peak hold circuit 48, whereby the peak hold circuit 48 is reset.

Next, at step 103, it is judged if the current crank angle is CA2 (FIG. 18) or not. When the crank angle is CA2, the routine proceeds to step 104, where the output voltage of the peak hold circuit 48 is read. At this time, the output voltage of the peak hold circuit 48 indicates the peak pressure $P_1$, therefore at step 104, the peak pressure $P_1$ is read. Next, at step 105, the reset signal is input to the reset input terminal R of the peak hold circuit 48, whereby the peak hold circuit 48 is reset. Next, at step 106, the differential pressure $\Delta P$ ($=P_1-P_0$) between the peak pressure $P_0$ and the peak pressure $P_1$ is calculated.

Next, at step 107, it is judged if the differential pressure $\Delta P$ is negative or not. When $\Delta P<0$, it is judged that defective combustion has occurred. At this time, the routine proceeds to step 109, where the defective combustion flag is set. As opposed to this, when $\Delta P>0$, it is judged that defective combustion has not occurred. At this time, the routine proceeds to step 108, where the defective combustion flag is reset.

Figure 20:
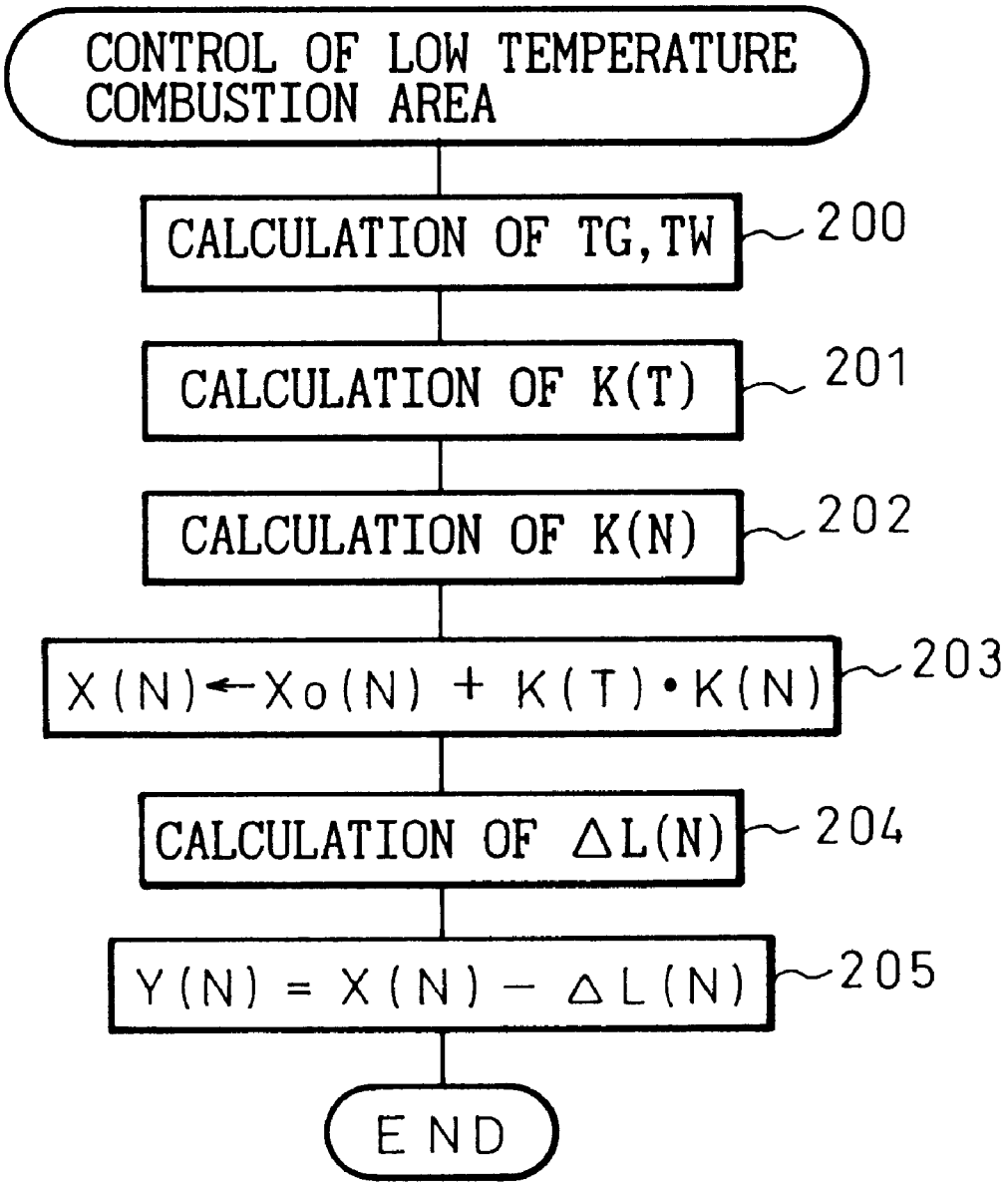
FIG. 20 is a flow chart of the control of a low temperature combustion region.

FIG. 20 shows the routine for control of the low temperature combustion region, that is, the first operating region I.

Referring to FIG. 20, first, at step 200, the temperature of the gas TG inside the combustion chamber 5 at the start of compression and the temperature TW of the cylinder inner wall are calculated. In this embodiment, the temperature of the mixed gas of the suction air and the EGR gas detected by the temperature sensor 43 is made the temperature of the gas TG in the combustion chamber 5 at the start of compression, while the temperature of the engine cooling water detected by the temperature detector 29 is made the temperature TW of the cylinder inner wall. Next, at step 201, $K(T)_1$ is found from the relationship shown in FIG. 11A, $K(T)_2$ is found from the relationship shown in FIG. 11B, and these $K(T)_1$ and $K(T)_2$ are added to calculate K(T) ($=K(T)_1+K(T)_2$).

Next, at step 202, K(N) is calculated from the relationship shown in FIG. 11C based on the engine rotational speed N. Next, at step 203, the value of the first boundary $X_0(N)$ stored in advance is used to calculate the value of the first boundary X(N) based on the following equation:

$$X(N)=X_0(N)+K(T)\cdot K(N)$$

Next, at step 204, $\Delta L(N)$ is calculated from the relationship shown in FIG. 7 based on the engine rotational speed N. Next, at step 205, $\Delta L(N)$ is subtracted from X(N) to calculate the value of the second boundary Y(N) ($=X(N)-\Delta L(N)$).

Next, an explanation will be given of the control of the operation with reference to FIG. 21.

Figure 21:
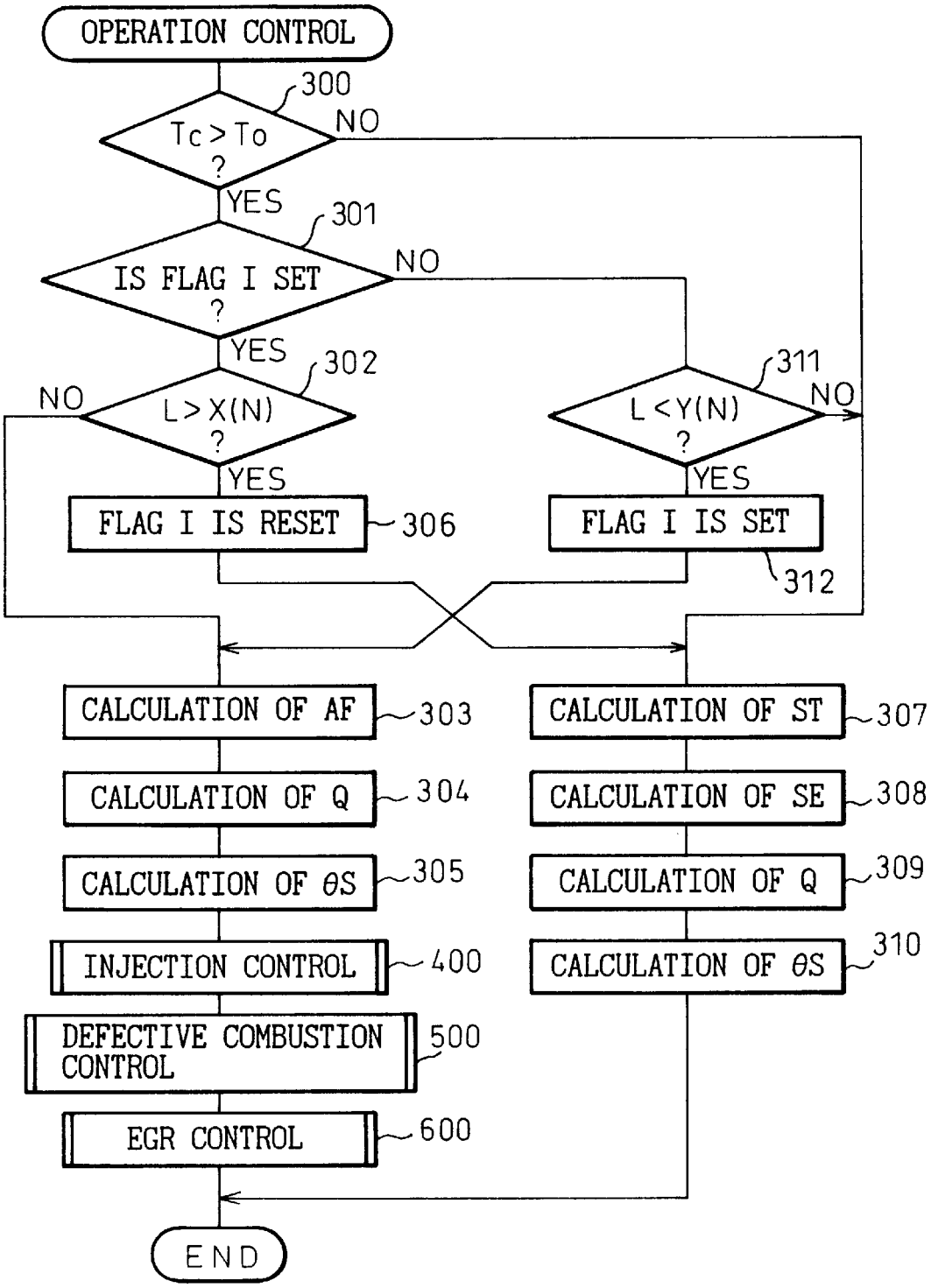
FIG. 21 is a flow chart of the control of engine operation.

Referring to FIG. 21, first, at step 300, it is judged if the temperature Tc of the exhaust gas passing through the catalyst 19 is higher than a predetermined $T_0$, that is, if the catalyst 19 has been activated or not, based on the output signal of the temperature sensor 46. When $Tc\leqq T_0$, that is, when the catalyst 19 has not been activated, the routine proceeds to step 307, where second combustion, that is, combustion by the conventional combustion method, is performed.

That is, at step 307, the target opening degree ST of the throttle valve 16 is calculated from the map shown in FIG. 17A, then at step 308 the target opening degree SE of the EGR control valve 23 is calculated from the map shown in FIG. 17B. next, at step 309, the injection amount Q is calculated, then at step 310, the injection start timing θS is calculated.

When it is judged at step 300 that $Tc>T_0$, that is, when the catalyst 19 is activated, the routine proceeds to step 301, where it is judged if a flag I showing that the engine operating region is the first operating region I is set or not. When the flag I is set, that is, when the engine operating region is the first operating region I, the routine proceeds to step 302, where it is judged if the required load L has become larger than the first boundary X(N) or not. When $L\leqq X(N)$, the routine proceeds to step 303, where low temperature combustion is performed.

Figures 22, 23:
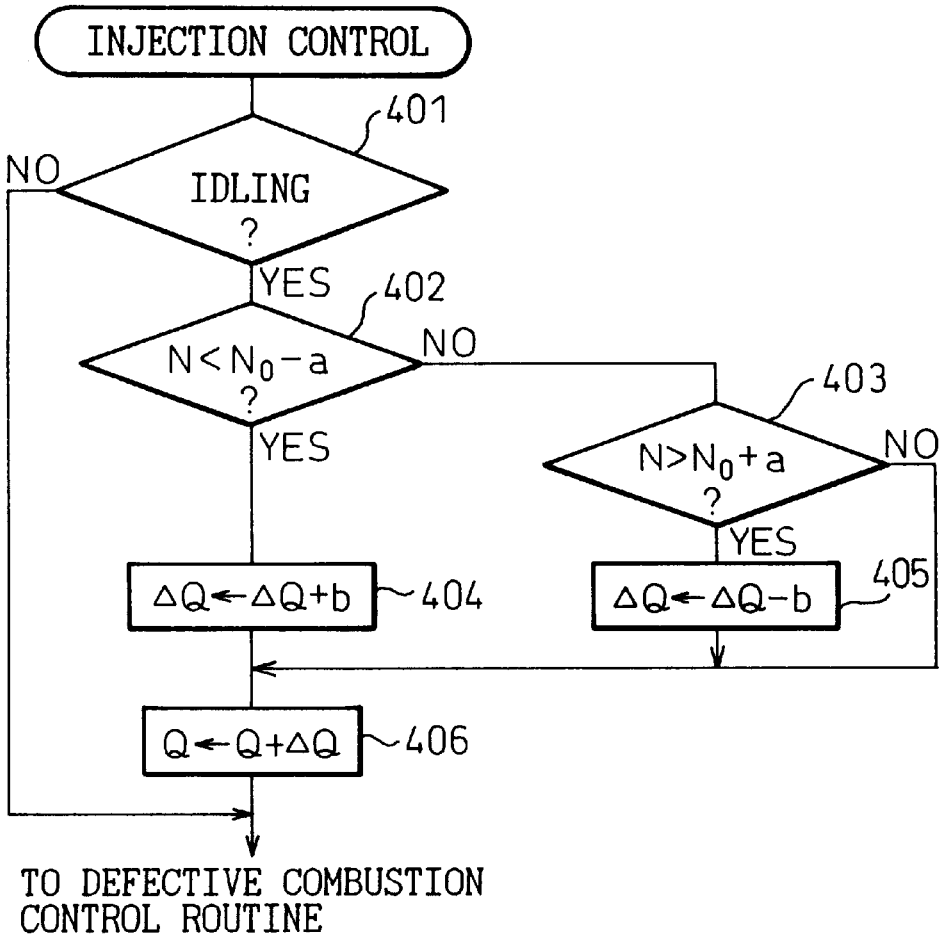
FIG. 22 is a view of a map of a target injection start timing.
FIG. 23 is a flow chart of injection control.
Figure 24:
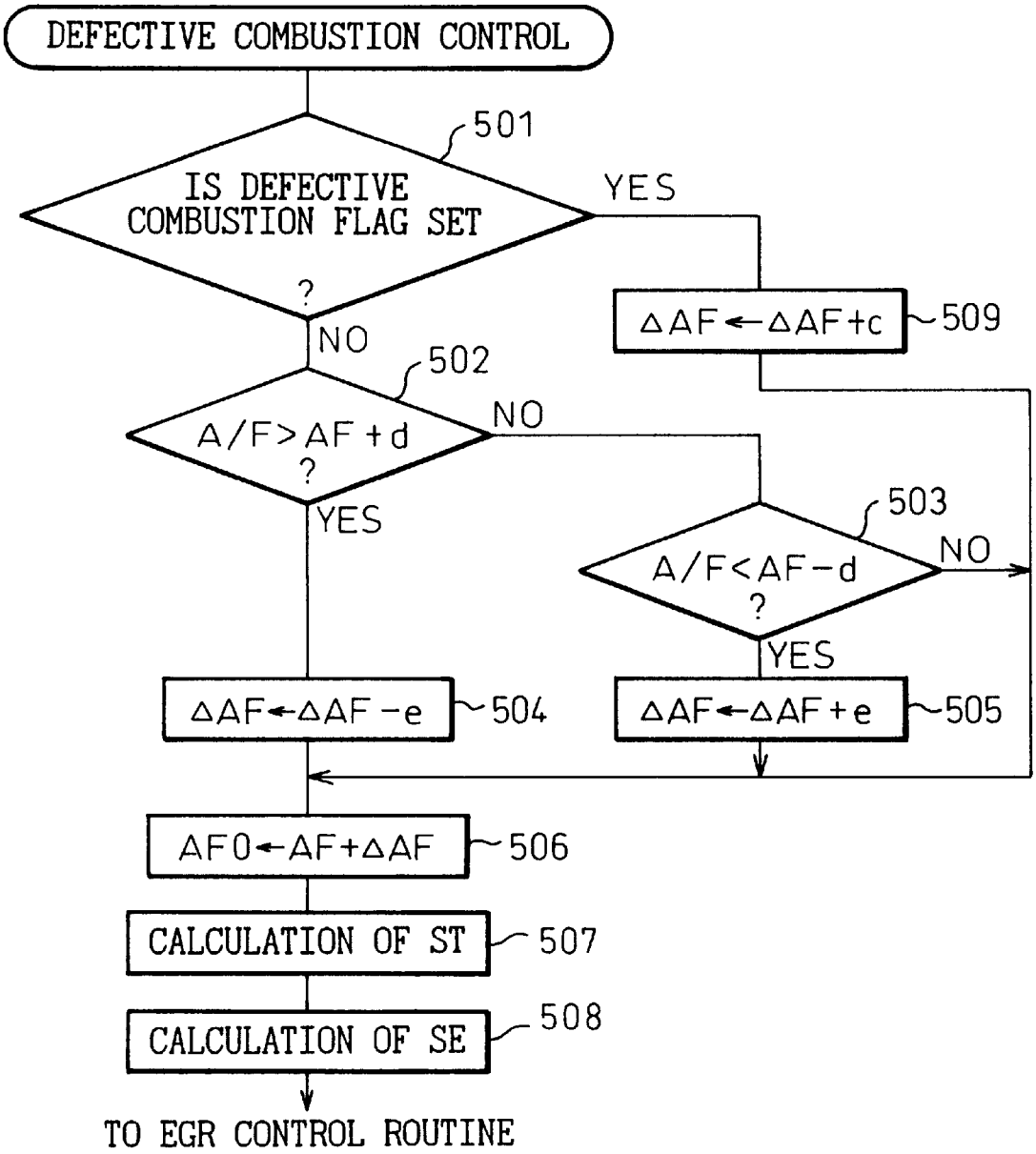
FIG. 24 is a flow chart of control of defective combustion.
Figure 25:
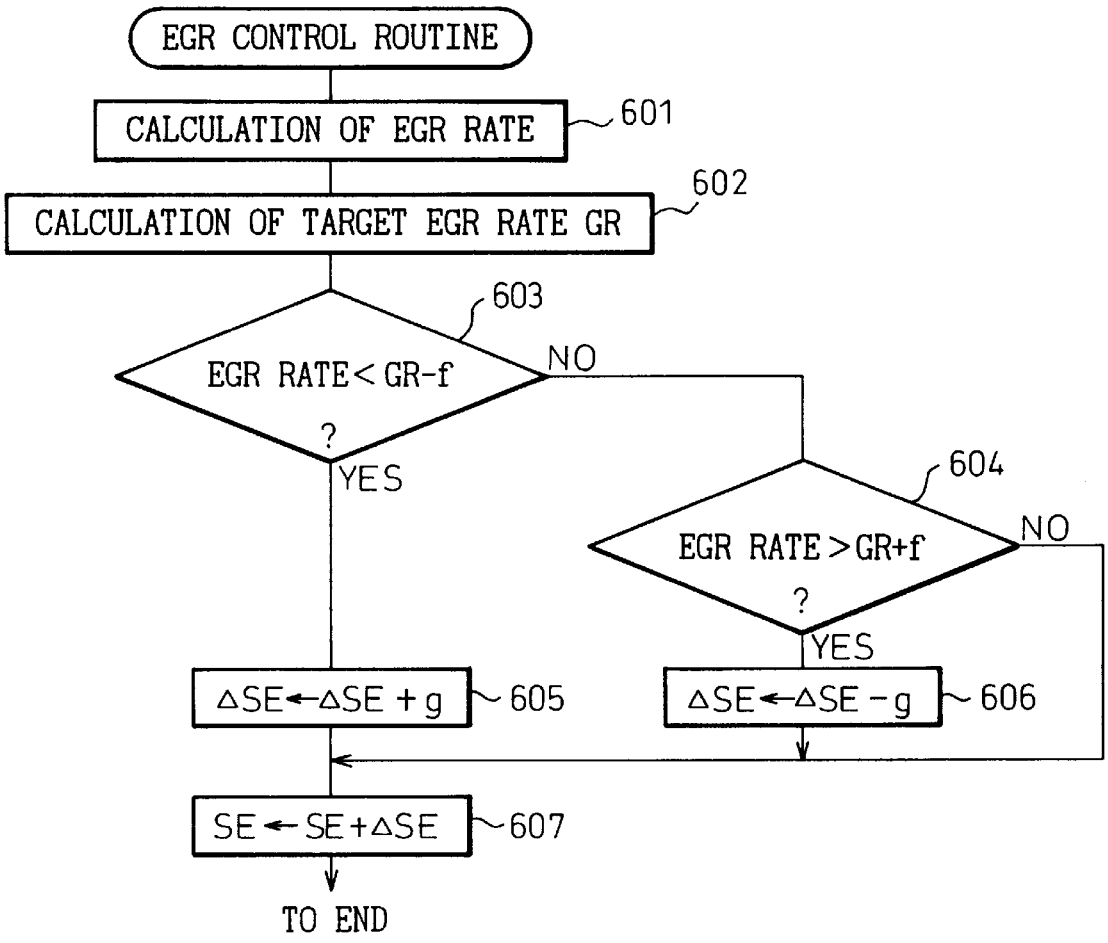
FIG. 25 is a flow chart of EGR control.

That is, at step 303, the two maps corresponding to K(T) out of the maps shown from FIGS. 13A to 13D are used to calculate the target air-fuel ratio AF by proportional distribution. Next, at step 304, the injection amount Q is calculated, then, at step 305, the injection start timing θS is calculated. The injection start timing θS is stored in advance in the ROM 32 as a function of the required load L and engine rotational speed N in the form of a map shown in FIG. 22. Next, at step 400, the injection control is performed. This injection control is shown in FIG. 23. Next, at step 500, defective combustion control is performed. This defective combustion control is shown in FIG. 24. Next, at step 600, EGR control is performed. This EGR control is shown in FIG. 25.

On the other hand, when it is judged at step 302 that $L>X(N)$, the routine proceeds to step 306, where the flag I is reset. Next, the routine proceeds to step 307, where the second combustion, that is, the conventionally performed normal combustion, is performed. On the other hand, when it is judged at step 301 that the flag I has been reset, that is, when the engine is operating in the second operating region II, the routine proceeds to step 311, where it is judged if the required load L has become smaller than the second boundary Y(N). When $L\geqq Y(N)$, the routine proceeds to step 307. As opposed to this, when $L<Y(N)$, the routine proceeds to step 312, where the flag I is set. Next, the routine proceeds to step 303, where low temperature combustion is performed.

Next, an explanation will be given of the injection control routine with reference to FIG. 23. Referring to FIG. 23, first, at step 401, it is judged if the engine is idling or not. If not idling, the defective combustion control routine is immediately proceeded to. As opposed to this, if idling, the routine proceeds to step 402.

At step 402, it is judged if the engine rotational speed N has become lower than the value (No−a), for example, the target idling speed No, (600 rpm) minus a predetermined value a, for example, 10 rpm, or not. When $N<N_0-a$, the routine proceeds to step 404, where a predetermined value b is added to a correction value ΔQ of the injection amount. Next, the routine proceeds to step 406, where the injection amount Q is increased by exactly the correction value ΔQ. On the other hand, if it is judged at step 402 that $N\geqq N_0-a$, the routine proceeds to step 403, where it is judged if the engine rotational speed N has become higher than the target idling speed $N_0$ plus the predetermined value a ($N_0+a$) or not. When $N>N_0+a$, the routine proceeds to step 405, where the predetermined value b is subtracted from the correction value ΔQ, then the routine proceeds to step 406.

That is, when the engine is idling, the injection amount Q is controlled so that the engine rotational speed N becomes $N_0-a<N<N<N_0+a$.

Next, the defective combustion control will be explained with reference to FIG. 24. Referring to FIG. 24, first, at step 501, it is judged if the defective combustion flag has been set or not. When the defective combustion flag has been reset, that is, when defective combustion has not occurred, the routine proceeds to step 502, where it is judged if the actual air-fuel ratio A/F detected by the air-fuel ratio sensor 21 has become larger than the target air-fuel ratio A/F plus a predetermined value d (AF+d) or not. When A/F>ΔF+d, the routine proceeds to step 504, where a predetermined value e is subtracted from the correction value ΔAF of the air-fuel ratio. Next, at step 506, the correction value ΔAF is added to the target air-fuel ratio AF to calculate a learned value AFO of the air-fuel ratio (=AF+ΔAF).

On the other hand, when it is judged at step 502 that A/F≦AF+d, the routine proceeds to step 503, where it is judged if the actual air-fuel ratio A/F detected by the air-fuel ratio sensor 21 is smaller than the target air-fuel ratio AF minus the predetermined value d (AF−d) or not. When A/F<AF−d, the routine proceeds to step 505, where the predetermined value e is added to the correction value ΔAF, then the routine proceeds to step 506. That is, when defective combustion has not occurred, the learned value AFO of the air-fuel ratio is calculated so that the actual air-fuel ratio A/F becomes substantially the target air-fuel ratio AF.

Next, at step 507, the two maps corresponding to the learned value AFO of the air-fuel ratio out of the maps shown from FIGS. 14A to 14D are used to calculate the target opening degree ST of the throttle valve 16 by proportional distribution and control the opening degree of the throttle valve 16 to the target opening degree ST. Next, at step 508, the two maps corresponding to the learned value AFO of the air-fuel ratio out of the maps shown from FIGS. 15A to 15D are used to calculate the target basic opening degree SE of the EGR control valve 23 by proportional distribution.

On the other hand, when it is judged at step 501 that the defective combustion flag has been set, that is, when defective combustion occurs, the routine proceeds to step 509, where a predetermined value c is added to the correction value ΔAF, then the routine proceeds to step 506. Accordingly, when defective combustion occurs, the learned value AFO of the air-fuel ratio gradually increases, whereby the actual air-fuel ratio gradually becomes larger. At this time, the opening degree of the throttle valve 16 gradually becomes larger so that the amount of suction air increases and the opening degree of the EGR control valve 23 also gradually increases so that the EGR rate becomes the target EGR rate.

Next, when defective combustion no longer occurs, the routine proceeds from step 501 to step 502, where the opening degree of the throttle valve 16 and the opening degree of the EGR control valve 23 gradually become smaller so that the actual air-fuel ratio A/F becomes the target air-fuel ratio AF.

Next, an explanation will be given of the EGR control with reference to FIG. 25. This EGR control is the control for making the EGR rate accurately match the target EGR rate. Referring to FIG. 25, first, at step 601, the actual EGR rate is calculated based on the output signal of the oxygen concentration sensor 44. That is, if the amount of suction air is Qa, the amount of EGR gas is Qg, and the concentration of oxygen detected by the oxygen concentration sensor 44 is $[O_2]$%, since the concentration of oxygen in the suction air is about 21 percent and the concentration of oxygen in the EGR gas is about 5 percent, the following equation stands:

$$(0.21 \cdot Qa + 0.05 \cdot Qg)/(Qa + Qg) = [O_2]$$

Here, the EGR rate is Qg/(Qa+Qg), so the above equation may be expressed as follows:

$$0.21 - 0.16 \cdot \text{EGR rate} = [O_2]$$

Therefore, if the oxygen concentration $[O_2]$ is detected by the oxygen concentration sensor 44, the actual EGR rate may be calculated.

Next, at step 602, the target EGR rate GR is calculated. Next, at step 603, it is judged if the actual EGR rate is smaller than the target EGR rate GR minus a predetermined value f or not. When the actual EGR rate<GR−f, the routine proceeds to step 605, where a predetermined value g is added to the correction value ΔSE of the opening degree of the EGR control valve 23. Next, at step 607, the correction value ΔSE is added to the target basic opening degree SE of the EGR control valve 23 to calculate the target opening degree SE. At this time, the opening degree of the EGR control valve 23 is increased.

On the other hand, when it is judged at step 603 that the actual EGR rate≧GR−f, the routine proceeds to step 604, where it is judged if the actual EGR rate is larger than the target EGR rate plus the predetermined value f (GR+f) or not. When the actual EGR rate>GR+f, the routine proceeds to step 606, where the predetermined value g is subtracted from the correction value ΔSE, then the routine proceeds to step 607. At this time, the opening degree of the EGR control valve 23 is reduced.

Figure 26:
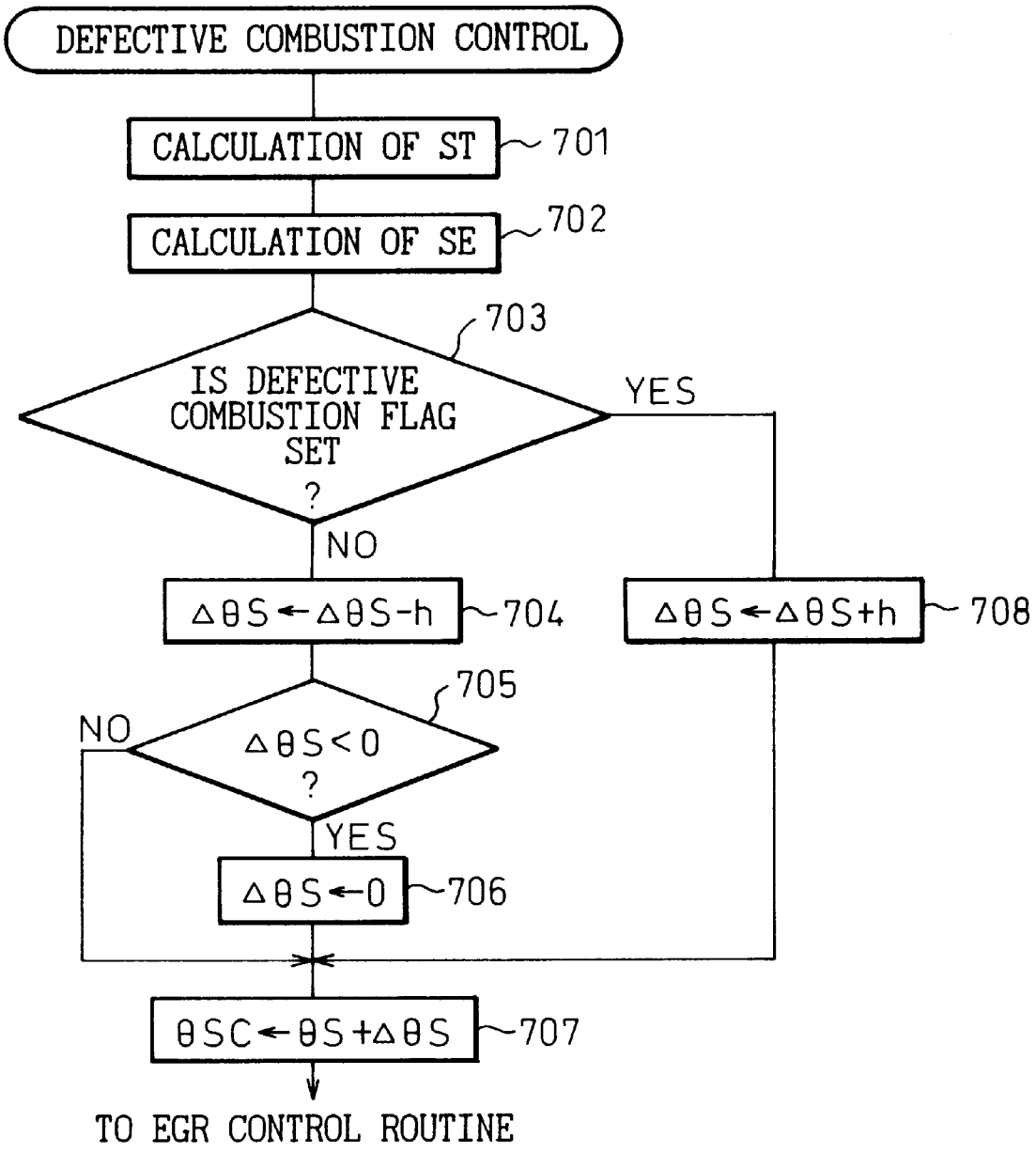
FIG. 26 is a flow chart of another embodiment for control of defective combustion.

FIG. 26 shows another embodiment of the defective combustion control shown in FIG. 24. In this embodiment, when defective combustion occurs, the injection start timing θS is made earlier.

That is, referring to FIG. 26, first, at step 701, the two maps corresponding to the target air-fuel ratio AF out of the maps shown from FIGS. 14A to 14D are used to calculate the target opening degree ST of the throttle valve 16 by proportional distribution and control the opening degree of the throttle valve 16 to the target opening degree ST. Next, at step 702, the two maps corresponding to the target air-fuel ratio out of the maps shown from FIGS. 15A to 15D are used to calculate the target basic opening degree SE of the EGR control valve 23 by proportional distribution.

Next, at step 703, it is judged if the defective combustion flag has been set. When the defective combustion flag has been set, that is, when defective combustion occurs, the routine proceeds to step 708, where a predetermined value h is added to the correction value ΔθS of the injection start timing. Next, at step 707, the correction value ΔθS is added to the target injection start timing θS shown in FIG. 22 to calculate the final injection start timing θSC. That is, when defective combustion is occurring, the injection start timing is gradually made earlier.

On the other hand, when the defective combustion flag has been reset, that is, when defective combustion is no longer occurring, the routine proceeds from step 703 to step 704, where the predetermined value h is subtracted from the correction value ΔθS. Next, at step 705, it is judged if the correction value ΔθS has become negative or not. When ΔθS<0, ΔθS is made zero at step 706, then the routine proceeds to step 707. That is, when defective combustion is no longer occurring, the injection start timing is gradually delayed until the target injection start timing θS shown in FIG. 22.

Figure 27:
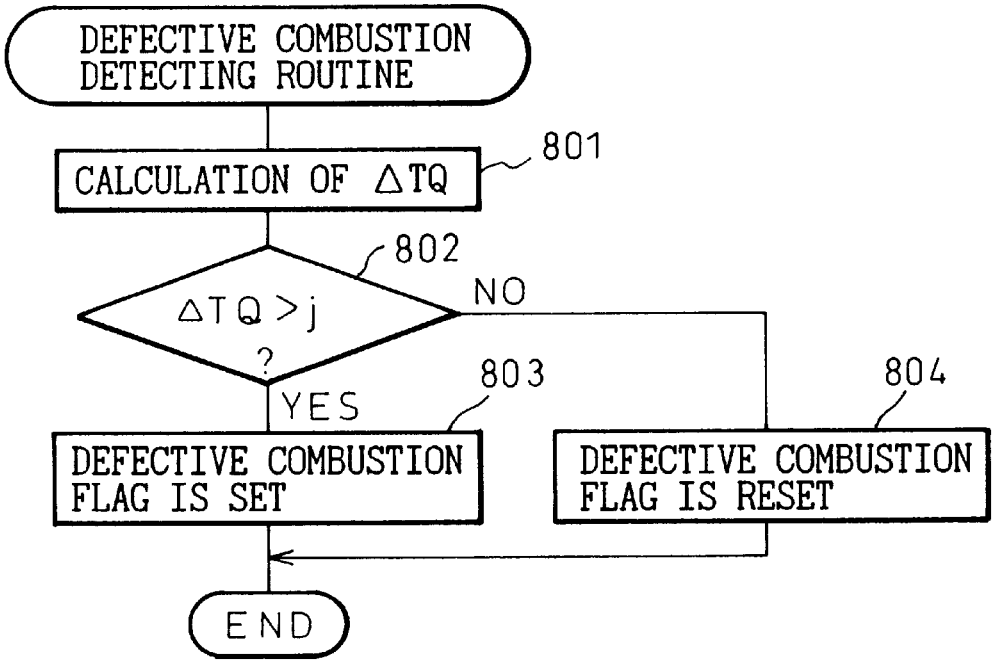
FIG. 27 is a view of another embodiment of a routine for detection of defective combustion.
Figure 28:
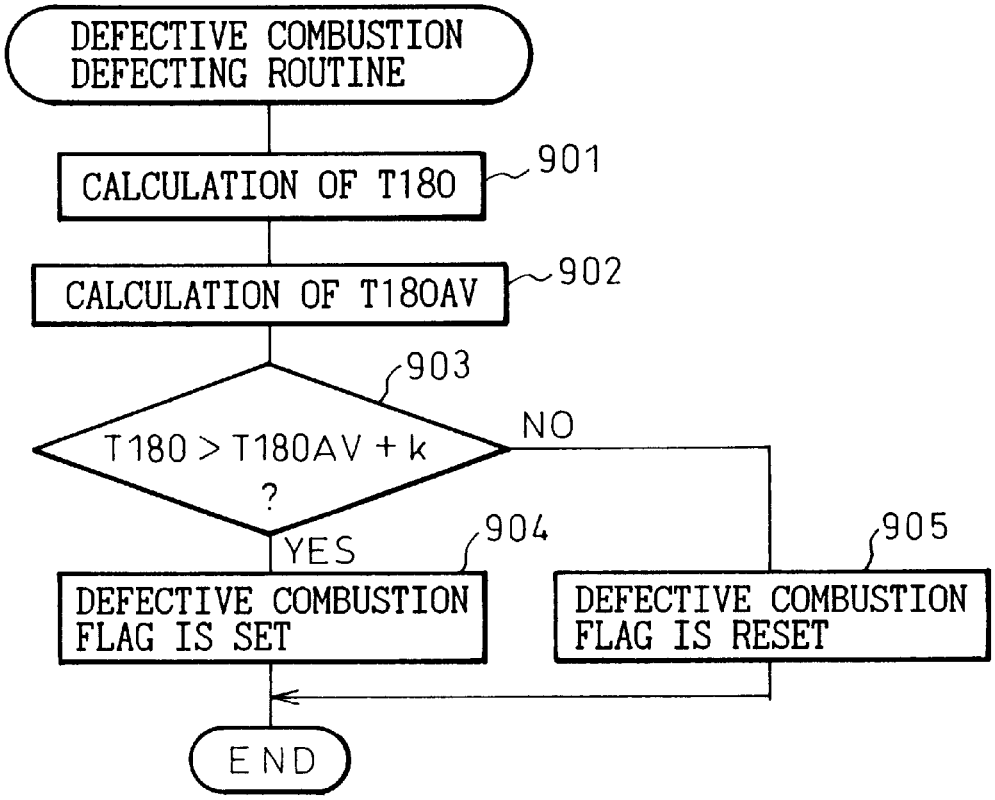
FIG. 28 is a view of still another embodiment of a routine for detection of defective combustion.

FIG. 27 and FIG. 28 show other embodiments of the defective combustion detection routine shown in FIG. 19.

FIG. 27 shows an embodiment where it is judged that defective combustion has occurred when the amount of fluctuation of the output torque has become large.

Referring to FIG. 27, first, at step 801, the amount of fluctuation ΔTQ of the output torque of the engine detected by the torque sensor 50 is calculated. Next, at step 802, it is judged if the amount of torque fluctuation ΔTQ is larger than a predetermined value j or not. When ΔTQ>j, the routine proceeds to step 803, where the defective combustion flag is set, while when ΔTQ≦j, the routine proceeds to step 804, where the defective combustion flag is reset.

FIG. 28 shows an embodiment where it is judged if defective combustion is occurring from the elapsed time T180 required for the crankshaft to rotate by the 180 degrees including the explosion stroke of the cylinders. That is, if defective compression occurs in a cylinder, the elapsed time T180 required for the crankshaft to rotate by the 180 degree crank angle including the explosion stroke of that cylinder becomes longer, so it can be judged from this that defective combustion has occurred.

That is, referring to FIG. 28, at step 901, the elapsed time T180 required for the crankshaft to rotate by the 180 degrees including the explosion stroke of the cylinders is calculated based on the output signal of the crank angle sensor 42. Next, at step 902, the average time T180AV of the most recent elapsed times T180 of all of the cylinders is calculated. Next, at step 903, it is judged if any of the elapsed times T180 of the cylinders is larger than the average value T180AV plus a predetermined value k (T180AV+k) or not. When T180>T180AV+k, the routine proceeds to step 904, where the defective combustion flag is set. When T180≦T180AV+k, the routine proceeds to step 905, where the defective combustion flag is reset.

Further, it is possible to arrange two terminals set a certain distance apart from each other in the combustion chamber 5 and apply voltage across these terminals to judge if defective combustion is occurring by whether an ion current flows across the terminals. That is, when combustion occurs, ions are generated in the combustion gas, so an ion current flows across the terminals. Accordingly, it is also possible to judge if defective combustion has occurred or not by whether an ion current is flowing.

According to the present invention, as mentioned above, it is possible to control the operating state of a compression ignition type engine when defective combustion occurs to an operating state free of defective combustion.

While the invention has been described by reference to specific embodiments chosen for purposes of illustration, it should be apparent that numerous modifications could be made thereto by those skilled in the art without departing from the basic concept and scope of the invention.

What is claimed is:

1. A compression ignition type engine comprising:

a combustion chamber;

means for detecting an increase in an amount of inert gas in the combustion chamber over a range to a certain amount, wherein an amount of production of soot gradually increases over the range and peaks at the certain amount, and detecting an increase in the amount of inert gas in the combustion chamber beyond the certain amount, wherein a temperature of fuel and surrounding gas at the time of combustion in the combustion chamber decreases such that an amount of production of soot decreases;

means for providing an amount of inert gas to the combustion chamber that is greater than the certain amount;

defective combustion judging means for judging whether defective combustion is occurring; and control means for controlling one of an air-fuel ratio and fuel injection timing so that combustion becomes good when defective combustion is occurring.

2. A compression ignition type engine as set forth in claim 1, wherein said control means makes the air-fuel ratio larger when defective combustion occurs.

3. A compression ignition type engine as set forth in claim 2, wherein said control means makes the air-fuel ratio gradually smaller toward a target air-fuel ratio determined by the operating state of the engine when good combustion is started due to the air-fuel ratio being made larger.

4. A compression ignition type engine as set forth in claim 1, wherein said control means makes the fuel injection timing earlier when defective combustion occurs.

5. A compression ignition type engine as set forth in claim 4, wherein said control means makes the fuel injection timing gradually later toward a target injection timing determined by the operating state of the engine when good combustion is started due to the fuel injection timing being made earlier.

6. A compression ignition type engine as set forth in claim 1, wherein a combustion pressure sensor is arranged in the combustion chamber and said defective combustion judging means judges if defective combustion is occurring or not based on a combustion pressure detected by said combustion pressure sensor.

7. A compression ignition type engine as set forth in claim 6, wherein a first peak of combustion pressure appears at substantially top dead center of a compression stroke, a second peak of combustion pressure appears after top dead center of the compression stroke, and said defective combustion judging means judges that defective combustion is occurring when the second peak pressure becomes lower than the first peak pressure.

8. A compression ignition type engine as set forth in claim 1, wherein detecting means is provided for detecting an amount of fluctuation of an output torque of the engine and wherein said defective combustion judging means judges if defective combustion is occurring based on the amount of torque fluctuation detected by said detecting means.

9. A compression ignition type engine as set forth in claim 8, wherein said defective combustion judging means judges that defective combustion is occurring when said amount of torque fluctuation becomes larger than a predetermined amount of fluctuation.

10. A compression ignition type engine as set forth in claim 1, wherein detecting means is provided for detecting an elapsed time required for a crankshaft to rotate by a predetermined crank angle including the explosion stroke of cylinders and wherein said defective combustion judging means judges if defective combustion is occurring based on the elapsed time detected by said detecting means.

11. A compression ignition type engine as set forth in claim 10, wherein said defective combustion judging means judges that defective combustion is occurring when said elapsed time becomes longer than an average value of the elapsed times of all of the cylinders by exactly a predetermined time.

12. A compression ignition type engine as set forth in claim 1, comprising means for detecting an engine rotational speed and, means for controlling a fuel injection amount so that the engine rotational speed becomes a target rotational speed at the time of idling.

13. A compression ignition type engine as set forth in claim 1, comprising means for detecting an air-fuel ratio and, means for controlling the air-fuel ratio to a target air-fuel ratio.

14. A compression ignition type engine as set forth in claim 1, comprising a control valve for controlling the amount of exhaust gas to be recirculated in an intake passage of the engine; means for calculating an exhaust gas recirculation rate; and means for controlling an opening degree of the control valve so that the exhaust gas recirculation rate becomes a target exhaust gas recirculation rate.

15. A compression ignition type engine as set forth in claim 1, wherein the means for providing includes switching means for selectively switching between a first combustion where the amount of the inert gas in the combustion chamber is larger than the certain amount of inert gas, and a second combustion where the amount of inert gas in the combustion chamber is equal to or smaller than the certain amount of inert gas, and a catalyst having an oxidation function and arranged in an exhaust passage of the engine is provided.

16. A compression ignition type engine as set forth in claim 15, wherein the catalyst is at least one of an oxidation catalyst, three-way catalyst, and NOx absorbert.

17. A compression ignition type engine as set forth in claim 15, wherein an exhaust gas recirculation apparatus is provided for recirculating exhaust gas exhausted from the combustion chamber into an engine intake passage and the inert gas includes recirculated exhaust gas.

18. A compression ignition type engine as set forth in claim 17, wherein the exhaust gas recirculation rate when the first combustion is being performed is at least about 55 percent.

19. A compression ignition type engine as set forth in claim 15, wherein an engine operating region is divided into a low load side first operating region where first combustion is performed and a high load side second operating region where second combustion is performed.

* * * * *